US011447972B2

(12) United States Patent
Borden

(10) Patent No.: US 11,447,972 B2
(45) Date of Patent: Sep. 20, 2022

(54) STORM AVOIDING BUILDINGS AND STRUCTURES

(71) Applicant: Eric John Borden, Swansea, MA (US)

(72) Inventor: Eric John Borden, Swansea, MA (US)

( * ) Notice: Subject to any disclaimer, the term of this patent is extended or adjusted under 35 U.S.C. 154(b) by 0 days.

(21) Appl. No.: 17/185,199

(22) Filed: Feb. 25, 2021

(65) Prior Publication Data

US 2021/0180357 A1 Jun. 17, 2021

Related U.S. Application Data

(63) Continuation-in-part of application No. 16/742,530, filed on Jan. 14, 2020, now Pat. No. 10,988,922.

(Continued)

(51) Int. Cl.

*E04H 9/14* (2006.01)
*A62C 35/13* (2006.01)

(Continued)

(52) U.S. Cl.

CPC ..... *E04H 9/12* (2013.01); *A62C 35/13* (2013.01); *B66F 7/0658* (2013.01); *E02D 27/32* (2013.01);

(Continued)

(58) Field of Classification Search

CPC .... E04H 9/08; E04H 9/12; E04H 9/14; E04H 9/04; E04H 9/10; E04H 9/16; E04B 1/34; E04B 1/0015; E04B 1/34336; E04B 1/3408; E04B 1/34352; E04B 1/34363; E04B 1/0007; B66F 7/0658; E02D 27/32; A62C 35/13; F24F 7/04

See application file for complete search history.

(56) References Cited

U.S. PATENT DOCUMENTS 5,794,389 A * 8/1998 Vysma ..... E02D 27/32 52/126.5
5,974,743 A * 11/1999 Vaia ..... E04H 9/14 52/169.1

(Continued)

FOREIGN PATENT DOCUMENTS

CN 106401258 A * 2/2017
GB 2416787 A * 2/2006 ..... E04B 1/34363

(Continued)

*Primary Examiner* — Ryan D Kwiecinski

(57) ABSTRACT

A building sheltering structure is configured to facilitate the shielding of domicile or building into an underground foundation before an emergency environmental condition arises. The foundation includes a cover plate and/or a second plate that translate horizontally to occlude the at least one domicile upon retraction into a secure cavity of the foundation by a lift assembly in the foundation cavity. The cover plate and second plate offer optimal protection to the domicile thereunder for various extreme conditions. Mounted atop the lift assembly, the at least one domicile can be fully retracted into the foundation cavity and completely shielded. The operation of the lift assembly is commanded and powered by a supply system, of which a processor facilitates emergency warnings and panic transmissions to signal for help. Further, a plurality of solar panels mounted atop the at least one domicile keeps the system charged for the use in emergency.

20 Claims, 20 Drawing Sheets

Related U.S. Application Data

(60) Provisional application No. 62/794,761, filed on Jan. 21, 2019.

(51) Int. Cl.

| | |
|---|---|
| ***B66F 7/06*** | (2006.01) |
| ***F24F 7/04*** | (2006.01) |
| ***E02D 27/32*** | (2006.01) |
| ***E04B 1/34*** | (2006.01) |
| ***E04H 9/12*** | (2006.01) |
| ***E04B 1/343*** | (2006.01) |

(52) U.S. Cl.

CPC ..... *E04B 1/34352* (2013.01); *E04B 1/34363* (2013.01); *E04H 9/14* (2013.01); *F24F 7/04* (2013.01)

(56) References Cited

U.S. PATENT DOCUMENTS

| | | | | |
|---|---|---|---|---|
| 6,338,596 | B1 * | 1/2002 | Galeazzi | B65F 1/1457 588/900 |
| 8,176,692 | B2 ‡ | 5/2012 | Crow | E04H 9/14 52/169 |
| 8,756,869 | B1 * | 6/2014 | Routt | E05C 1/10 49/33 |
| 10,041,268 | B1 ‡ | 8/2018 | Bunn | E04H 9/14 |
| 11,274,456 | B2 * | 3/2022 | Forrest | E04H 9/14 |
| 2005/0092218 | A1 * | 5/2005 | Saucier | E04B 1/34363 109/1 S |
| 2009/0120014 | A1 * | 5/2009 | Picarazzi | E04B 1/34363 52/169.6 |
| 2015/0101262 | A1 ‡ | 4/2015 | Groves | E04H 9/14 52/67 |
| 2018/0347176 | A1 * | 12/2018 | Cho | E04B 1/98 |

FOREIGN PATENT DOCUMENTS

| | | | | |
|---|---|---|---|---|
| KR | 200350361 | Y1 ‡ | 5/2004 | |
| WO | WO-9630602 | A1 * | 10/1996 | E04B 1/34363 |
| WO | WO2001002658 | A1 ‡ | 1/2001 | |
| WO | WO2017142167 | A1 ‡ | 8/2017 | |

* cited by examiner
‡ imported from a related application

DETAIL A
SCALE 1 : 3.5

STORM AVOIDING BUILDINGS AND STRUCTURES

The current application is a continuation-in-part (CIP) application of a U.S. non-provisional application Ser. No. 16/742,530 filed on Jan. 14, 2020. The U.S. non-provisional application Ser. No. 16/742,530 claims a priority to a U.S. provisional application Ser. No. 62/794,761 filed on Jan. 21, 2019.

FIELD OF THE INVENTION

The present invention relates generally to dwelling foundations. More specifically, the present invention relates to a dwelling foundation that is actuated to retract and deploy at least one domicile in and out of the foundation, further particularly with a support and supply system therein.

BACKGROUND OF THE INVENTION

Presently, the magnitude and volatility of natural disasters is observably magnifying, wherein the domiciles of individuals are subject to the conditions thereof and requiring addressing proceeding any deterioration or destruction thereof. It is therefore the objective of the present invention to introduce a foundation that facilitates the retraction and shielding of at least one domicile into the foundation before an emergency environmental condition arises. After proceeding the emergency environmental condition, the present invention exposes and deploys the at least one domicile outside of the foundation. The present invention introduces a lift assembly with a lift actuator thereof that is mounted to the underside of the at least one domicile and further located within the cavity of the foundation. Where the lift assembly or the at least one lift thereof facilitates deployment and collapsing to raise the at least one domicile respectively through the foundation aperture, whereupon the lift assembly is commanded and powered by the supply system that comprises a processor. Further the processor accommodates a beacon and a relay that facilitate transmissions thereto and from to intercept emergency warnings in anticipation of the emergency environmental conditions, and further facilitating a panic or trouble transmission to signal for help. Additionally, the supply system accommodates a plurality of solar panels that may be mounted atop at least one domicile to keep the system charged in the event of an emergency environmental condition. Further, the foundation accommodates a plurality of support apertures that accommodate a support actuator therein that may deploy and retract within the foundation aperture to support the underside of the top platform of the at least one lift, mitigating the strain of the lift actuator over extended periods of time. The foundation accommodates a cover plate that may translate horizontally as engaged by at least one cover actuator to occlude the at least one domicile upon retraction into the foundation cavity. By incorporating the lift assembly within the foundation that accommodates at least one domicile atop the lift assembly, the present invention is capable of retracting at least one domicile into a secure foundation cavity where a cover plate may be utilized to shield the foundation cavity from debris, flooding, and fire from impacting the at least one domicile.

SUMMARY OF THE INVENTION

A building sheltering structure of the present invention can be configured to facilitate the retracting and shielding of at least one domicile or building into an underground foundation before an emergency environmental condition arises. After proceeding the emergency environmental condition, the building sheltering structure exposes and deploys the at least one domicile outside of the foundation. The present invention introduces a lift assembly with a lift actuator thereof that is mounted to the underside of the at least one domicile and further located within a cavity of the foundation. The foundation includes a cover plate that translates horizontally to occlude the at least one domicile upon retraction into the secure cavity of the foundation by the lift assembly, which is positioned at the bottom of the foundation cavity. By mounting the at least one domicile atop the lift assembly, the at least one domicile can be fully retracted into the foundation cavity and completely shielded by the cover plate, which closes the foundation cavity through covering a topmost aperture thereof. Further, the building sheltering structure of the present invention may offer a second plate that is installed in parallel to and beneath the cover plate. The second plate provides another level of protection to the at least one domicile in situations where the cover plate is under extreme conditions such as wild fire, exposure, smoke and/or fire, being exposed to extreme high temperature, catastrophic damage/destruction, etc. A heating, ventilation, and air conditioning (HVAC) system, temperature sensors, and fire sprinkler system may be equipped to control the foundation cavity when the cover plate is activated and closed. The HVAC system can be used to heat the cover plate when exposed to cold weather, and/or melt the snow/ice accumulated thereon. Additionally, when the cover plate is exposed to extremely high temperature, and/or fire, smoke, both the HVAC system and the fire sprinkler system can effectively and efficiently monitor the space between the cover plate and the second plate when both are activated and closed, thus offering optimal protection to the at least one domicile under severe conditions.

The operation of the lifting and retracting of the lift assembly is commanded and powered by a supply system, which is attached to the at least one domicile and the foundation. A processor of the supply system includes a beacon and a relay and is connected to a plurality of batteries. The processor facilitates emergency warnings and panic transmissions to signal for help through the beacon while manages the lifting and retracting of the at least one domicile through the relay that is connected to the lift assembly. The process is also wirelessly connected to an extraneous personal computing (PC) device of a user, which provides the user a complete and efficient control of the present invention.

Additionally, the supply system accommodates a plurality of solar panels mounted atop the at least one domicile. The plurality of solar panels can be used to generate electricity while exposed and keep the system charged for the use in emergency. The plurality of solar panels is also electrically connected to the plurality of batteries and the processor, which controls the power generation and storage operations. Further, the supply system includes at least one container and a thermal unit. The at least one container and the thermal unit are both connected to the at least one domicile and the foundation. Both the container and the thermal unit provide conditioned air, water/liquid circulations between the at least one domicile and the surroundings of the foundation, and are connected to the processor, which provides controls of circulations of water/liquid, and HVAC (heating, ventilation, and air conditioning), etc.

Further, the building sheltering structure includes a satellite structure which is located adjacent and connected to the foundation. The satellite structure comprises a satellite foundation and a satellite tunnel. The satellite tunnel, positioned at the bottom of the satellite structure, connects the foundation cavity and a satellite cavity of the satellite foundation, thus the user can access the foundation cavity through the satellite structure exterior to the foundation in case the main access to the foundation cavity through the foundation aperture is closed in emergency and/or due to any system malfunction.

Thus, the building sheltering structure of the present invention is capable of retracting at least one domicile into the secure foundation cavity and completely shielded by the cover plate from debris, flooding, and fire from impacting the at least one domicile while provides various functions including communication with others and monitoring of comfortable indoor conditioned for the at least one domicile.

DETAIL DESCRIPTIONS OF THE INVENTION

Figure 1:
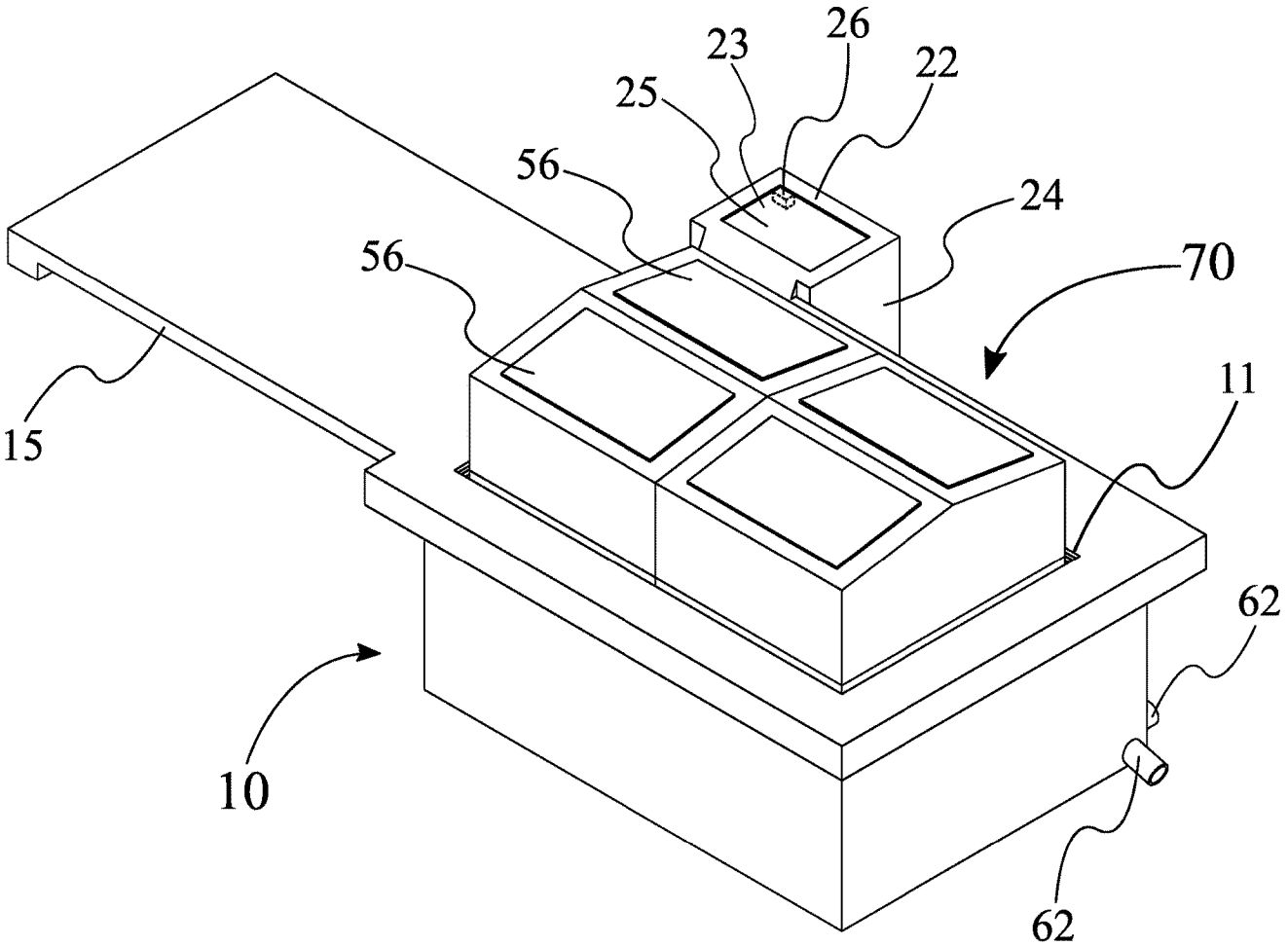
FIG. 1 is a perspective view of the apparatus of the present invention with at least one domicile embodied by a count of two is observed.
Figure 2:
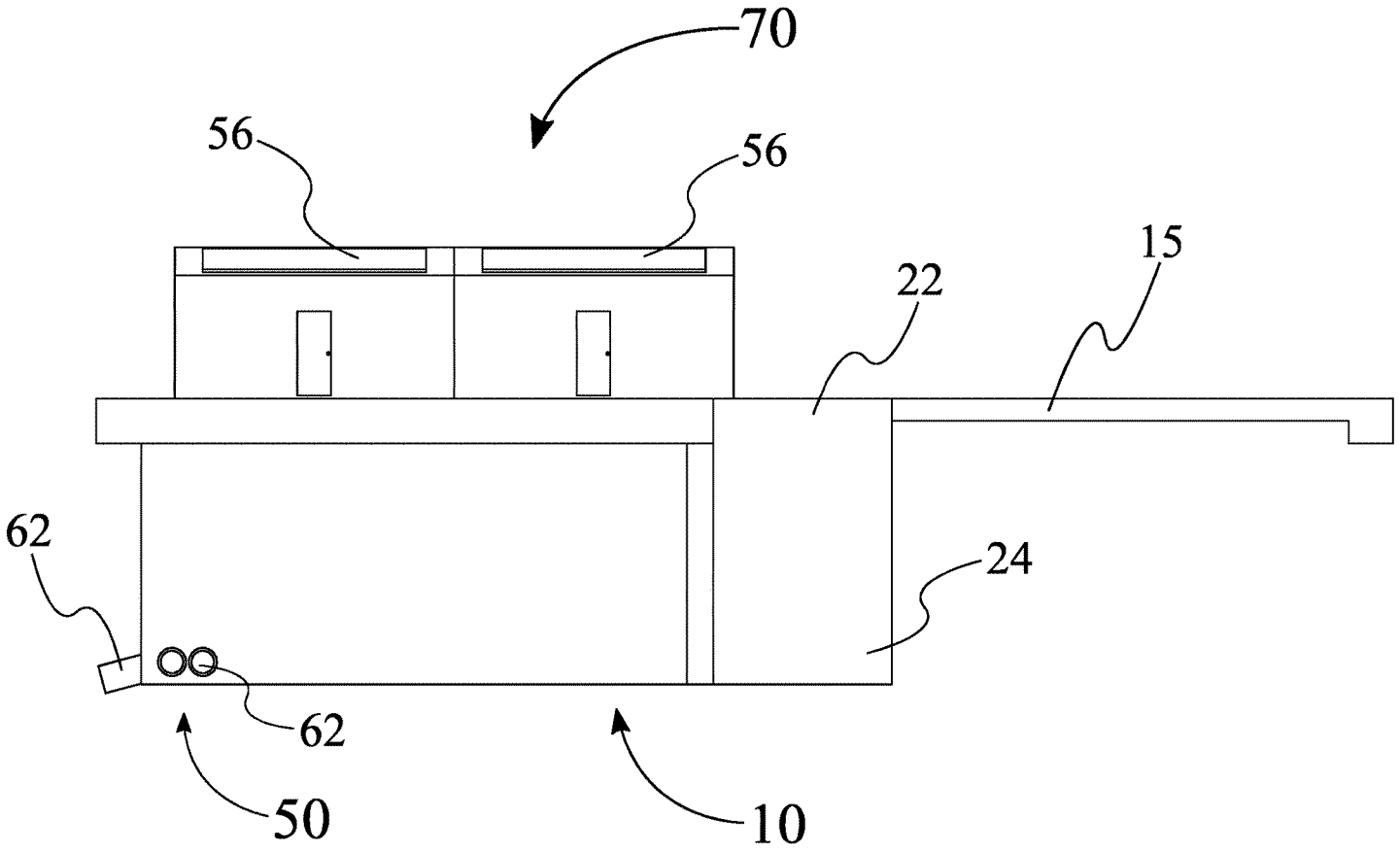
FIG. 2 is a front view of the apparatus of the present invention, wherein a plurality of pipes is observed on the lower left of the foundation.
Figure 3:
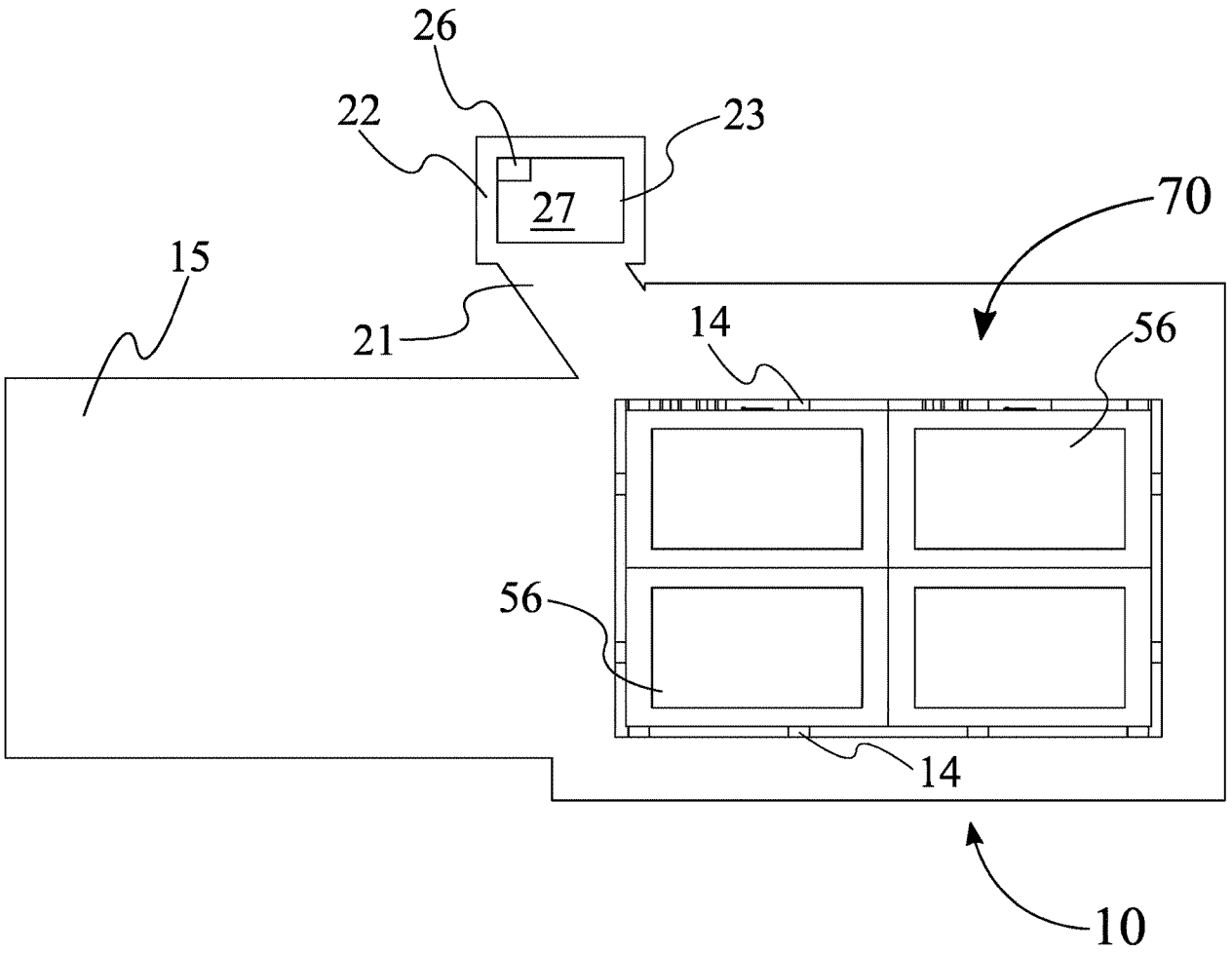
FIG. 3 is a top view of the apparatus of the present invention, wherein a satellite cover plate is observed within a satellite aperture.

All illustrations of the drawings are for the purpose of describing selected versions of the present invention and are not intended to limit the scope of the present invention.

As can be seen in FIG. 1 to FIG. 13, the present invention is a building sheltering structure comprising a system for environmental damage mitigation and actuation means thereof. Specifically, the building sheltering structure of the present invention comprises a foundation 10, a lift assembly 30, a supply system 50, and at least one domicile 70. The at least one domicile 70 can include, but is not limited to, a residential building, a shelter, a commercial building, an office, a clinic, a dormitory, or any suitable building, etc. Additionally, the at least one domicile 70 is connected with the lift assembly 30, which is installed within the foundation 10 and driven by the supply system 50. The at least one domicile 70 can be elevated out of the foundation 10, retracted and fully concealed within the foundation 10 by the lift assembly 30 during emergency and/or whenever is needed by a user. The supply system 50 can supply water and/or other liquids, and conditioned air to the at least one domicile 70, generate and store electrical energy through solar panels of the supply system 50. Further, the supply system 50 can provide manual and automatic control of various functions through wired and/or wireless communication between the user and the present invention.

As can be seen in FIG. 1 to FIG. 12, the foundation 10 of the present invention comprises a foundation aperture 11, a foundation cavity 12, and a cover assembly 15. The cover assembly 15 is exteriorly attached to the foundation 10 adjacent the foundation aperture 11. Additionally, the cover assembly 15 comprises a cover plate 18, and cover cavity 16. The cover plate 18 is movably positioned within the cover cavity 16 and translationally adapted to open and close the foundation aperture 11. The lift assembly 30 is positioned within the foundation cavity 12 opposite the foundation aperture 11. The lift assembly 30 is mounted to the at least one domicile 70 and configured to selectively elevate and retract the at least one domicile 70 through the foundation aperture 11. The foundation cavity 12 further comprises a plurality of support apertures 13 and a plurality of support actuators 14. The cover cavity 16 further comprises a cover aperture 17 and at least one cover actuator 19.

As can be seen in FIG. 1 to FIG. 12, in the preferred embodiment of the present invention, the foundation 10 is disposed within an elevation of a piece of land such as a hill or similar. The foundation 10 may include, but is not limited to, a metallic and non-porous material. Additionally, the foundation 10 is preferably rectilinear or cubic in shape with a rectilinear protrusion spanning from one of the lateral surfaces thereof along or near the top edge. The foundation 10 preferably accommodates the securing or motion of cables, hoses, and/or pipes of various systems and components of the present invention, including, but not limited to, the foundation 10, the lift assembly 30, the supply system 50, and the at least one domicile 70. The foundation 10 further preferably possesses a vertically reversed plinth shape that accommodates an offset rectilinear edge or outward facing rim that accommodates any support actuators and apertures where the support actuators are mounted thereof. The foundation aperture 11 is located on the top surface of the foundation 10 and bored vertically downward, wherein the foundation aperture 11 is preferably rectilinear in profile and open to the foundation cavity, forming an L-shaped lateral profile that spans the longitudinal dimension of the foundation aperture 11. The foundation aperture 11 may further be occluded by the cover plate 18 upon engagement by the at least one cover actuator 19. The foundation aperture 11 further preferably comprises along the perimeter thereof a gasket or seal that mitigates the introduction of fluids to the underlying foundation cavity 12. Below the foundation aperture 11 and in connection therewith is the foundation cavity 12, wherein the foundation cavity 12 is preferably rectilinear or cubic and offset and lesser than the exterior surfaces of the foundation 10. Additionally, the foundation cavity 12 houses the lift assembly 30 and the supply system 50 at all times and selectively the at least one domicile 70 upon retraction.

Located with a top edge vertically beneath the at least one domicile 70, which has completely been lifted out of the foundation aperture 11 and bored normal to the surfaces of the foundation aperture 11 is the plurality of support apertures 13. Specifically, the plurality of support apertures 13 is distributed interiorly on the foundation 10 adjacent the foundation aperture 11. Each of the plurality of support apertures 13 comprises a support actuator 14, which is movably mounted within each of the plurality of support apertures 13. Additionally, the support actuator 14 is adapted to slide in and out of each of the plurality of support apertures 13 to support the cover plate 18 of the foundation 10 or the at least one domicile 70.

Preferably, the plurality of support apertures 14 comprises a rectilinear profile and a count of 12 in an exemplified embodiment, or at least four for every individual lift of the lift assembly 30. Additionally, the individual support aperture of the plurality of support apertures 13 accommodates the support actuator of the plurality of support actuators 14 therein, permitting horizontal translation therethrough. The plurality of support apertures 13 is preferably arranged to dispose a support actuator the plurality of support actuators 14 at or near the corner of the respective lift of the lift assembly 30, thus stabilizing the lift assembly when the at least one domicile 70 is deployed exterior to the foundation cavity 12. Disposed within the individual support apertures of the plurality of support apertures 13 is the support actuator of the plurality of support actuators 14. In an exemplified embodiment, the plurality of support actuators 14 preferably comprises a linear actuator and a rectilinear protrusion attached to the end thereof. Each of the plurality of support actuators 14 linearly translates the rectilinear protrusion outward from the surface of the foundation aperture 11. The top planar surface of the rectilinear protrusion rests beneath the at least one domicile 70, which has completely been lifted out of the foundation aperture 11.

As can be seen in FIG. 1 to FIG. 3, and FIG. 7 to FIG. 12, the cover assembly 15 of the foundation 10 comprises a cover cavity 16, cover aperture 17, a cover plate 18, and at least one cover actuator 19. The cover aperture 17 is terminally positioned on the cover cavity 16, which is interiorly positioned on the foundation 10. The at least one cover actuator 19 is interiorly mounted to at least one distal end of the foundation 10 and is mounted to the cover plate 18 adjacent the cover aperture 17. The at least one cover actuator 19 is adapted to translate the cover plate 18 to open and close the foundation cavity 16 through the foundation aperture 17 of the foundation 10. Additionally, the at least one cover actuator 19 comprises a pulley mechanism that is interiorly mounted on either distal end of the foundation 10.

Located adjacent to the foundation 10 and open to the foundation cavity 12 through the cover aperture 17 is the cover cavity 16, wherein the cover cavity 16 is offset and lesser than the rectilinear protrusion of the foundation cavity 12 and houses the cover plate 18 therein. The cover cavity 16 facilitates the horizontal translation of the cover plate 18 through the cover aperture 17 when engaged by the at least one cover actuator 19. Disposed along one of the lateral walls of the foundation aperture 17 and normal thereof is the cover aperture 17. The cover aperture 17 opens the cover cavity 16 up to the foundation aperture 11, permitting the passage of the cover plate 18. Deployed and retracted within the cover cavity 16 through the cover aperture 17 is the cover plate 18. The cover plate 18 comprises a surface area equal to or greater than the foundation aperture 11. The cover plate 18 is mounted to the at least one cover actuator 19 to open and close the foundation aperture 11. When the cover plate 18 is deployed, the foundation aperture 11 is closed, and inversely when the cover plate 18 is retracted the foundation aperture 11 is open. Preferably, the cover plate 18 comprises a metallic or similarly robust material that can withstand damage, impact, and heat administered thereto, whereupon the cover plate 18 facilitates a shield for the at least one domicile 70 when retracted within the foundation cavity 12. Disposed on at least one distal end of the foundation 10 and vertically coincident with the cover aperture 17 and the cover plate 18 is the at least one cover actuator 19. Preferably, the at least one cover actuator 19 embodies a winch or pulley mechanism that is located on either distal end of the foundation 10. Although other actuation means may be employed including, but not limited to, rack and pinion systems, linear actuation systems, magnetic driven systems, and so on. The at least one cover actuator 19 linearly translates the cover plate 18 through the cover cavity 16 and the cover aperture 17 to shield the at least one domicile 17.

As can be seen in FIG. 1 to FIG. 3, and FIG. 7 to FIG. 12, the foundation 10 of the present invention further comprises satellite tunnel 21, and a satellite structure 22. The satellite structure 22 comprises a satellite aperture 23, a satellite foundation 24, a satellite cover plate 25, a satellite cover actuator 26, and a satellite cavity 27. The satellite structure 22 is positioned adjacent the foundation 10 and is connected to the foundation 10 through the satellite tunnel 21. Further, the satellite cavity 27 is positioned within the satellite structure 22. The satellite aperture 23 is positioned on the satellite structure 22 adjacent the foundation aperture 11 of the foundation 10. The satellite cavity 27 is connected with the foundation cavity 12 of the foundation 10 through the satellite tunnel 21. The satellite tunnel 21 may be disposed between the satellite foundation 24 and the foundation 10, wherein the satellite tunnel 21 facilitates traversal between the primary foundation 10 and the satellite foundation 24 for maintenance without having to retract the at least one domicile 70 into the foundation cavity 12 of the foundation 10. The satellite foundation 24 may be located adjacent and separate of the main foundation 10, wherein the satellite foundation 24 may support a smaller structure such as a shed, garage, or pet dwelling. The satellite foundation 24 may utilize similar scaled down variants of the lift assembly 30 without the necessity of a supply system (or at least the fluid constituent components thereof). Thus, the satellite foundation 24 may permit a single person to descend into the satellite cavity 27 therein and traverse the satellite tunnel 21 to perform maintenance of the lift assembly 30. Further, the satellite structure 22 comprises a satellite cover plate 25 and a satellite cover actuator 26. The satellite cover actuator 26 is mounted to the satellite foundation 24. Specifically, the satellite cover actuator 26 is positioned within the satellite cavity 27 adjacent the satellite aperture 23. The satellite cover plate 25 is mounted to the satellite foundation 24 adjacent the satellite aperture 23 and is connected with the satellite cover actuator 26. The satellite actuator 26 is configured to selectively open and close the satellite cavity 27 through translating the satellite cover plate 25 over the satellite aperture 23. Specifically, the satellite aperture 23 is located along the top surface of the satellite foundation 24, wherein through the satellite aperture 23 the satellite cover actuator 26 facilitates translational operations of the satellite cover plate 25 to selectively open and close the satellite cavity 27. Further, a structure mounted atop a scaled down lift assembly 30 may deploy through the satellite aperture 23. The satellite cover plate 25, thus, may translate linearly through the horizontal satellite cavity 27 of the satellite structure 22, where the satellite cover plate 25 facilitates a shield to the smaller structure allocated to the satellite foundation 24. Mounted to the satellite cover plate 25 and the satellite foundation 24 is the satellite cover actuator 26. The satellite cover actuator 26 preferably linearly translates the satellite cover plate 25 to occlude the satellite aperture 23. However, other means of actuation may be employed, including, but not limited to, hinged actuation means, magnetic actuation means, rack and pinion actuation means, and so on.

Figure 4:
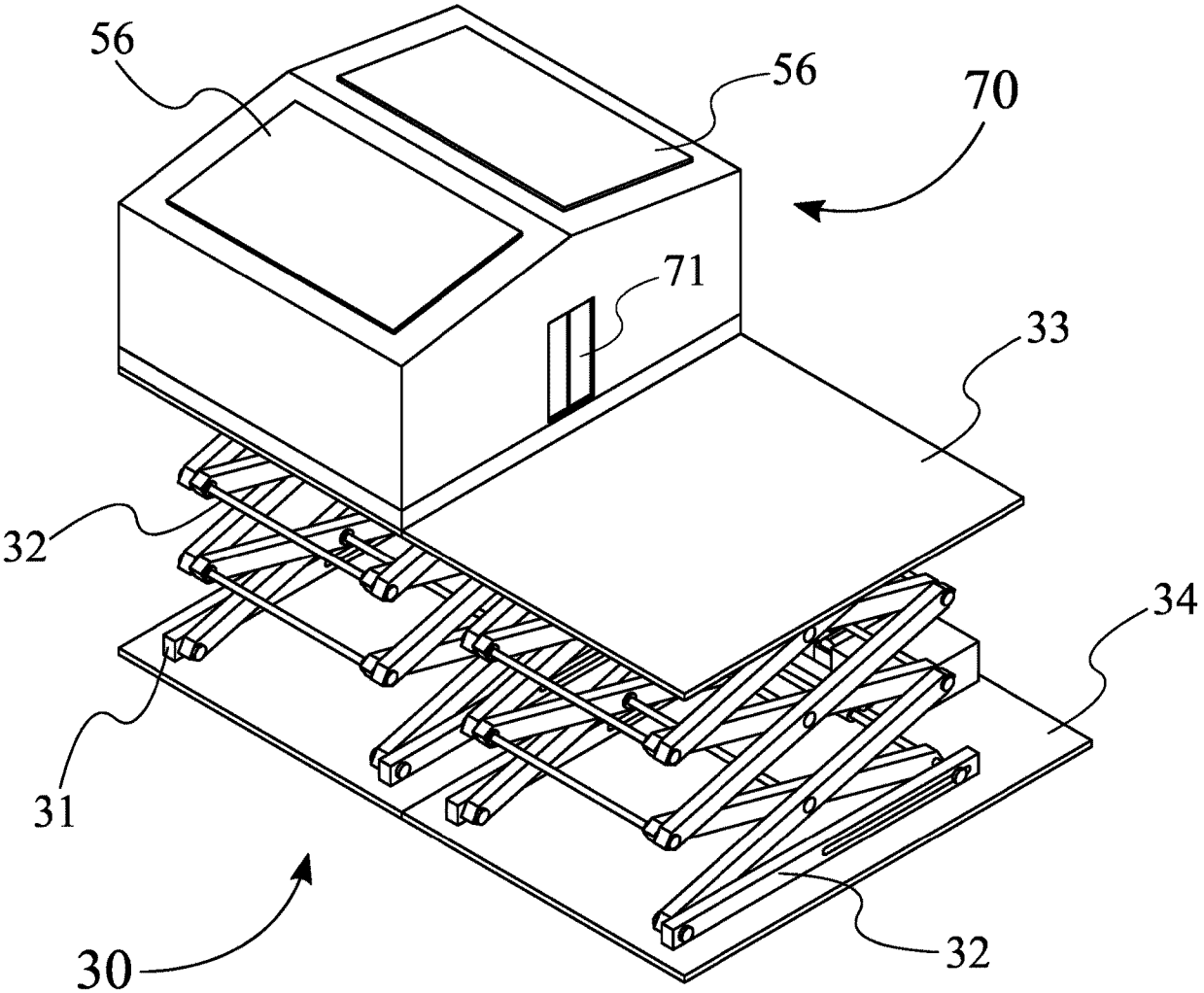
FIG. 4 a perspective view of a lift assembly alongside at least one domicile of the present invention, wherein the exemplified embodiment of two lifts of the at least one lift of the lift assembly is observed.
Figure 5:
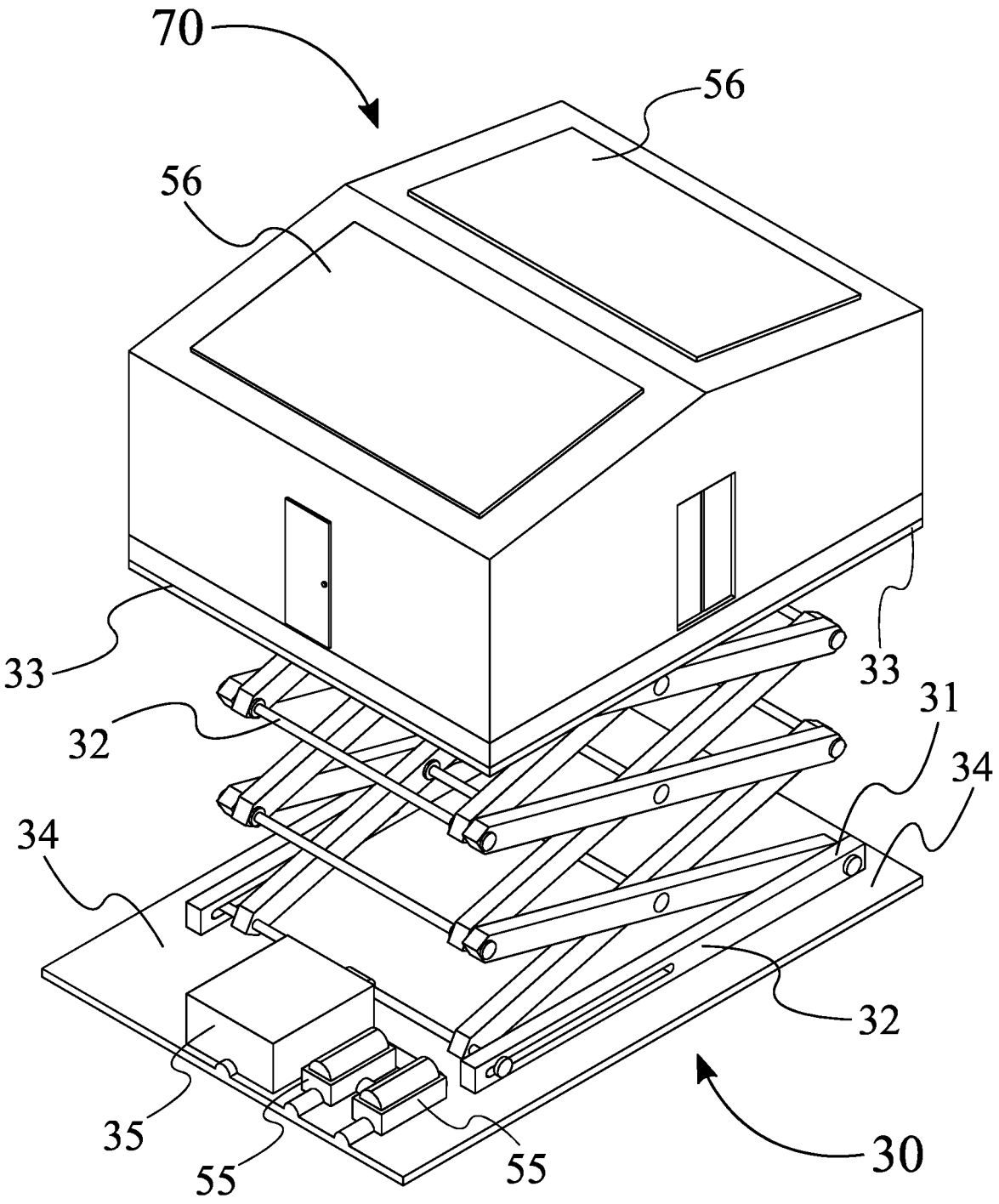
FIG. 5 is a perspective view of the lift assembly supporting at least one domicile thereon in a deployed state where a lift actuator and the plurality of batteries are observed while the manual lift crank has been omitted.
Figure 6:
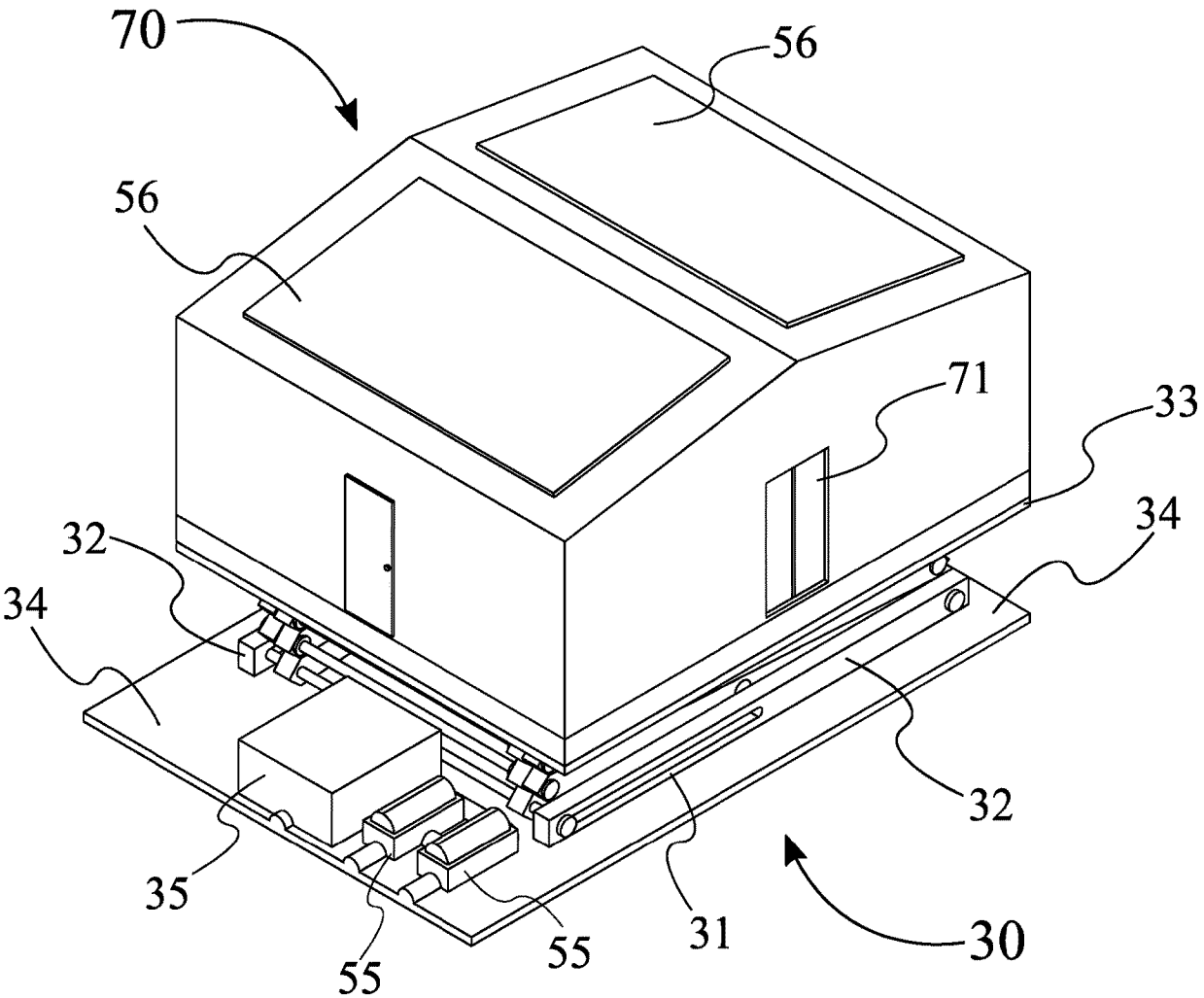
FIG. 6 is a perspective view of the lift assembly supporting at least one domicile thereon in a retracted state of the present invention, wherein the at least two batteries allocated to the at least one lift of the lift assembly.
Figure 7:
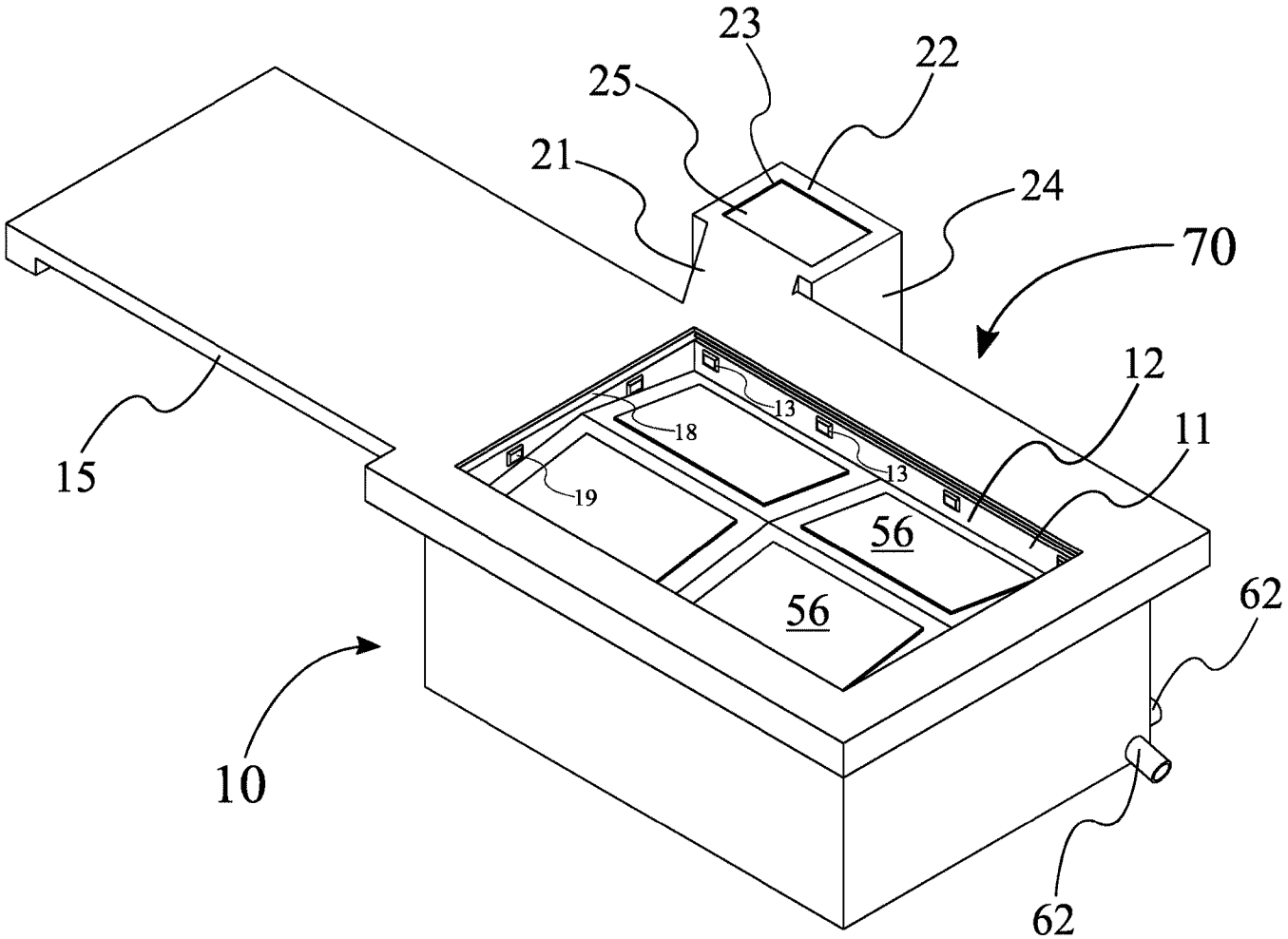
FIG. 7 is a perspective view of the apparatus of the present invention, wherein at least one domicile (or the plurality thereof) is retracted into the foundation cavity where support actuators are retracted into the walls of the foundation, and wherein at least one cover actuator is mounted to the cover plate within the cover cavity and passing through the cover aperture.
Figure 8:
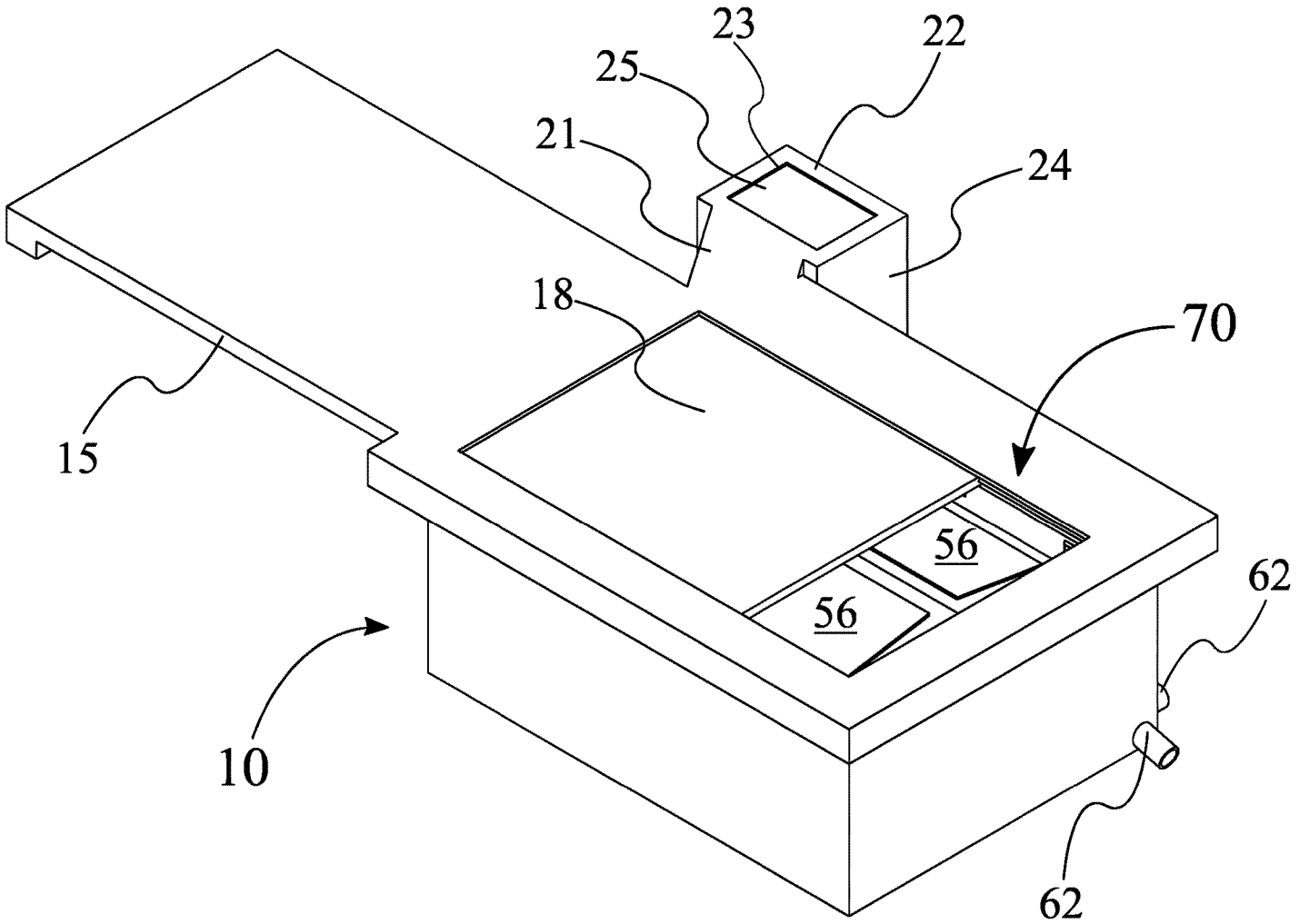
FIG. 8 is a perspective view of the apparatus of the present invention, wherein the cover plate is being deployed to occlude the foundation aperture.
Figure 9:
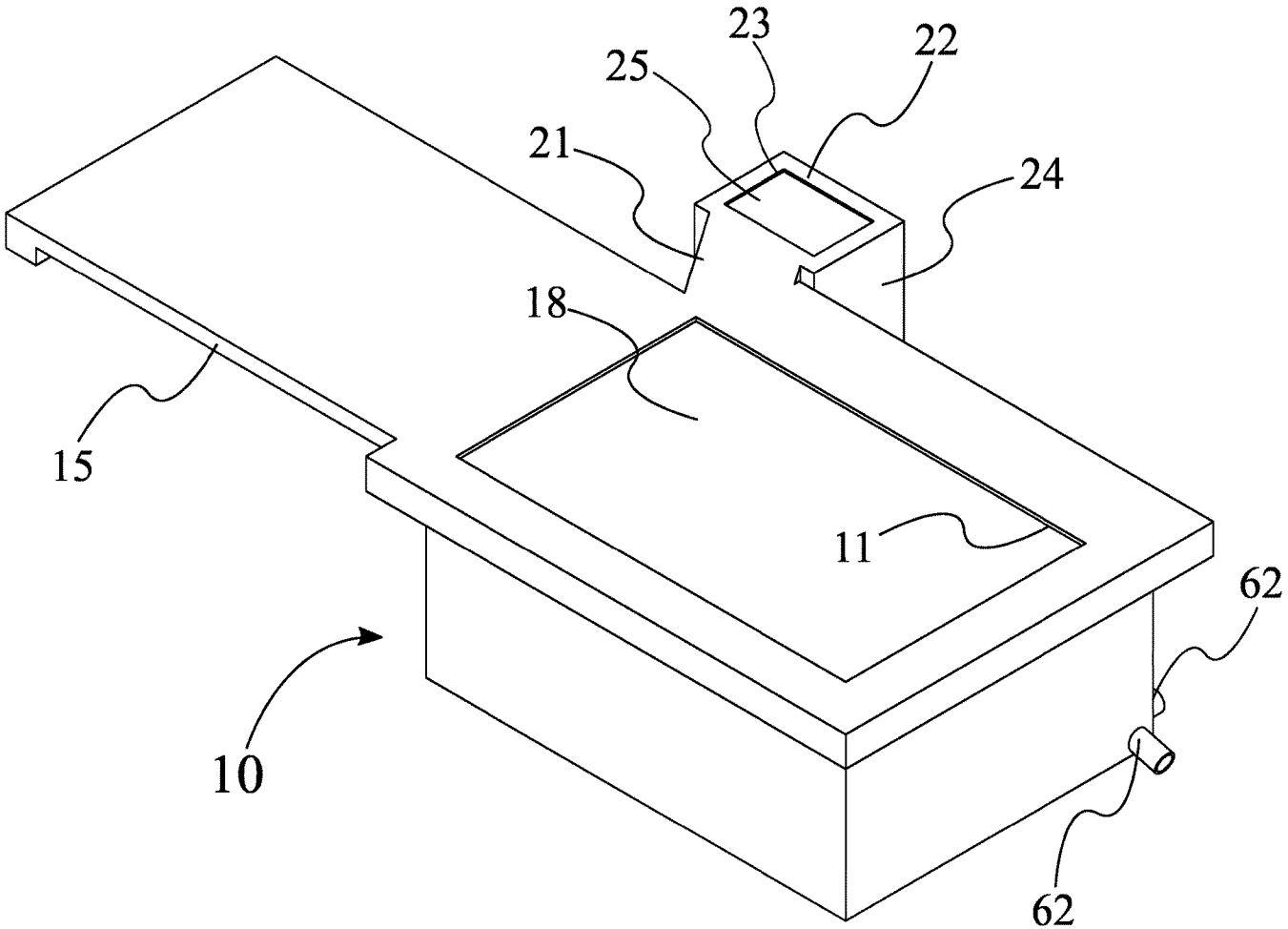
FIG. 9 is a perspective view of the apparatus of the present invention, wherein the cover plate has fully deployed to occlude the foundation aperture completely.
Figure 10:
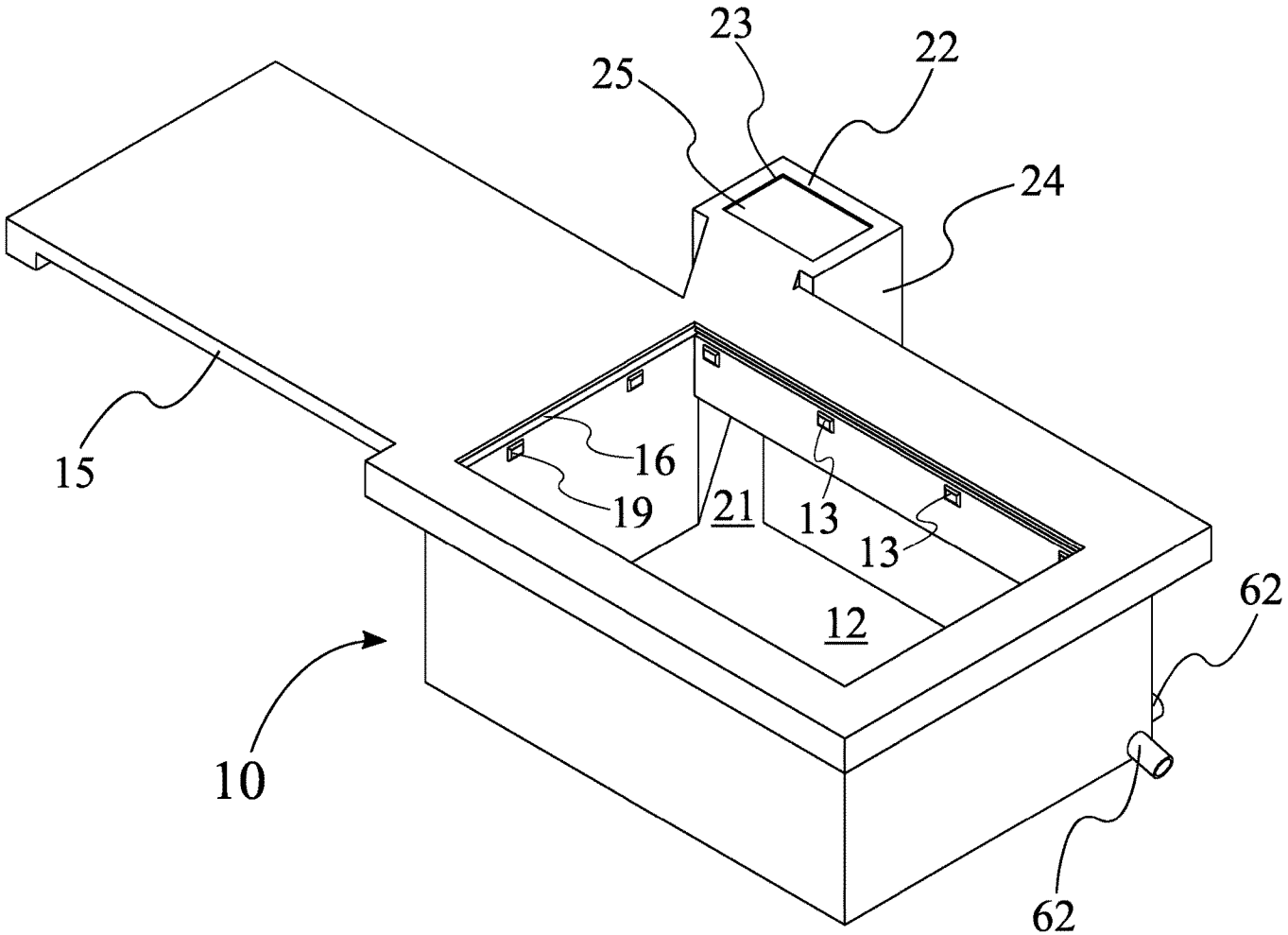
FIG. 10 is a perspective view of the apparatus of the present invention, wherein the at least one domicile and the lift assembly are omitted alongside retracting the cover plate, and wherein the satellite tunnel is connecting the foundation cavity and the satellite foundation.
Figure 11:
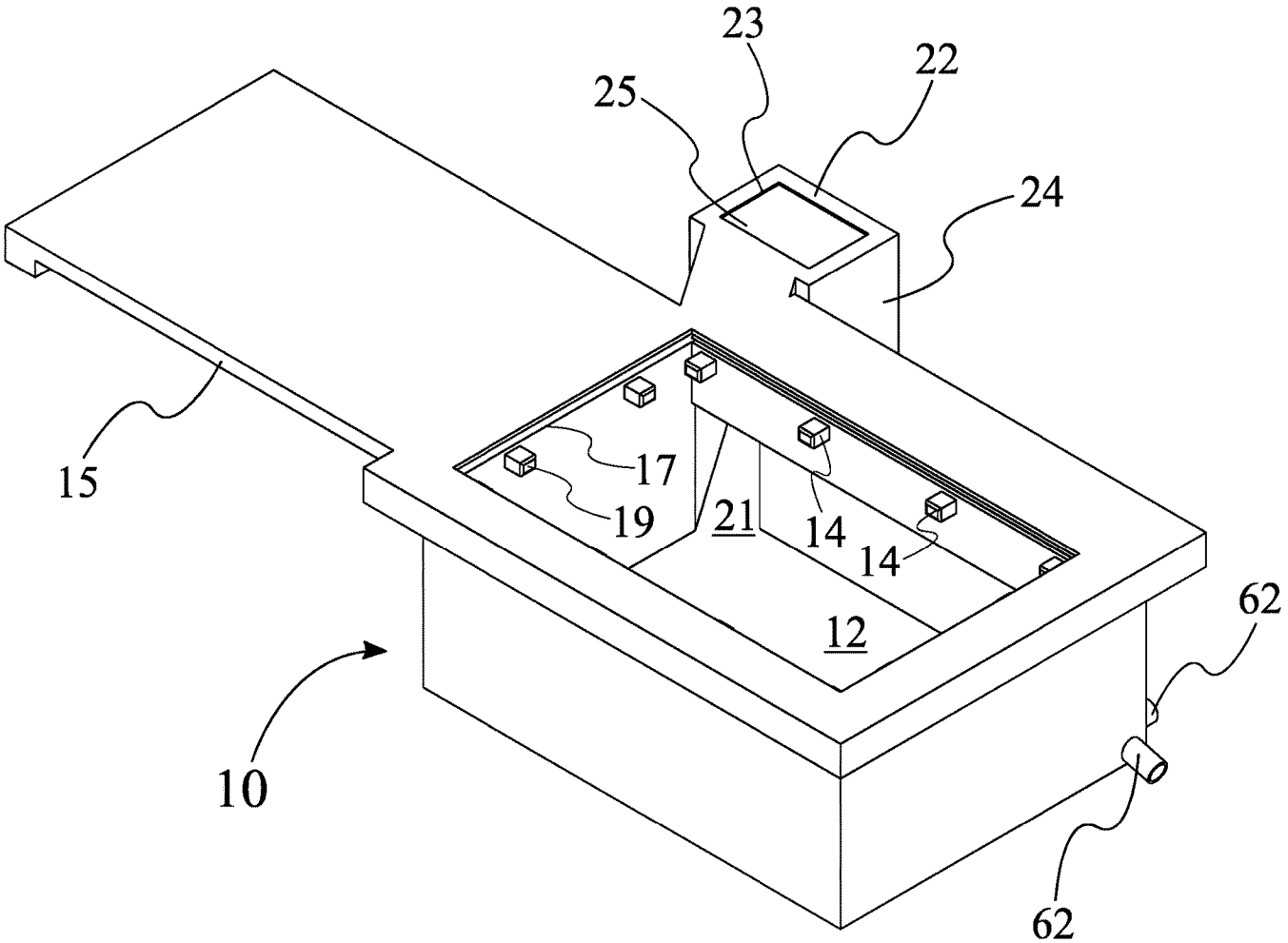
FIG. 11 is a perspective view of the apparatus of the present invention, wherein the plurality of support actuators is deployed through a plurality of support apertures.
Figure 12:
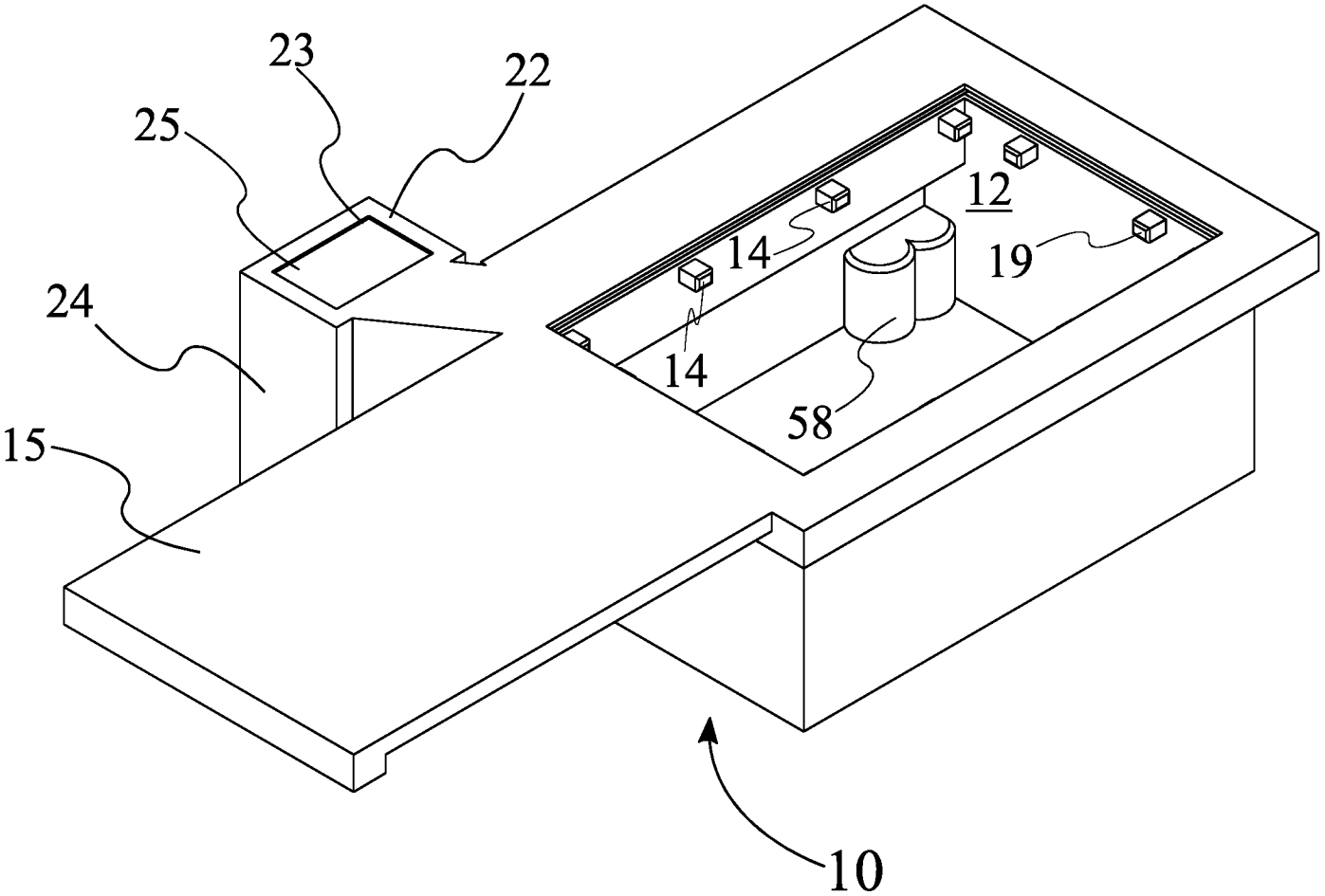
FIG. 12 is a perspective view of the apparatus of the present invention, wherein at least one tank is observed in the foundation cavity.
Figure 13:
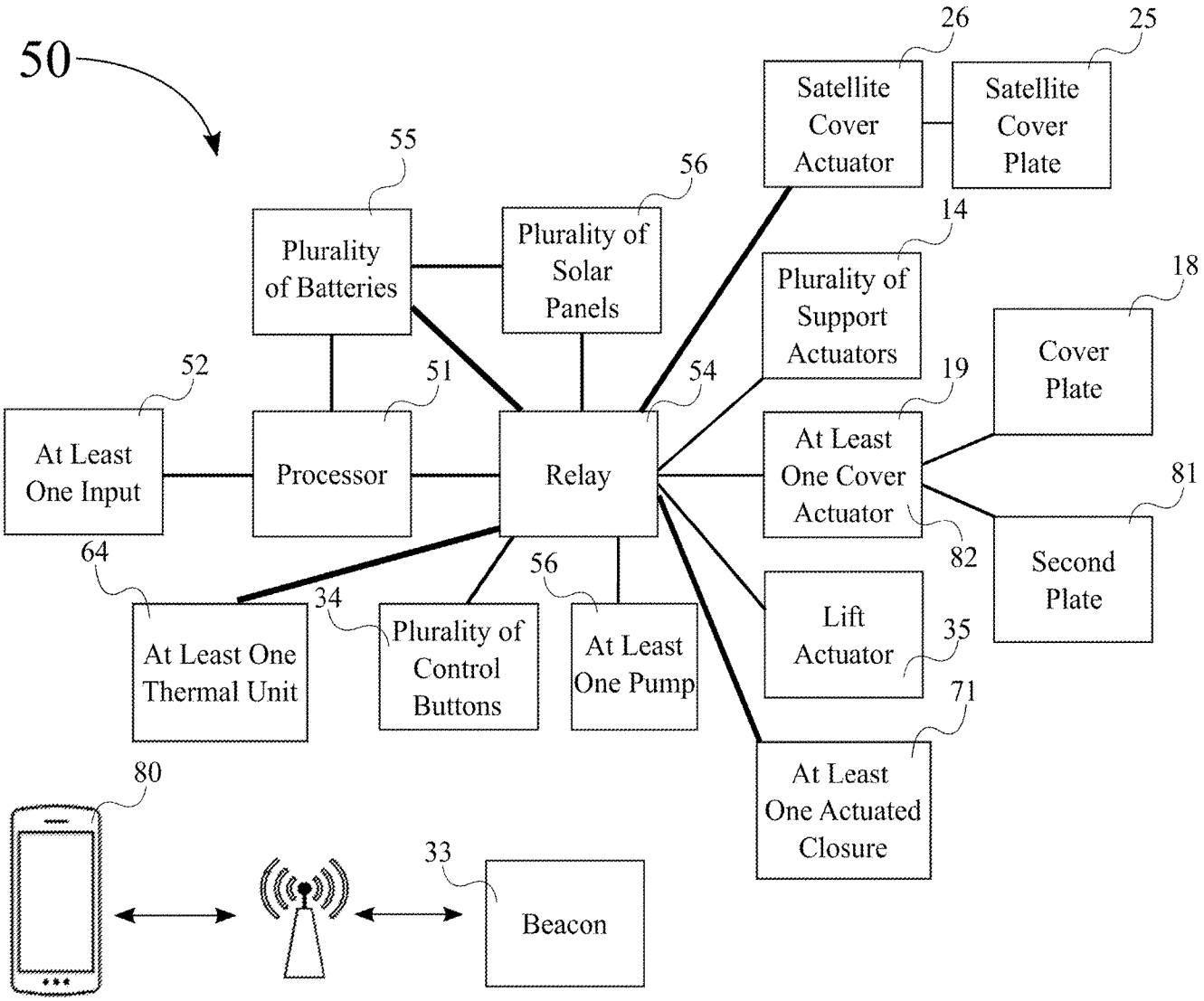
FIG. 13 is an electrical diagram of the apparatus of the present invention.
Figure 14:
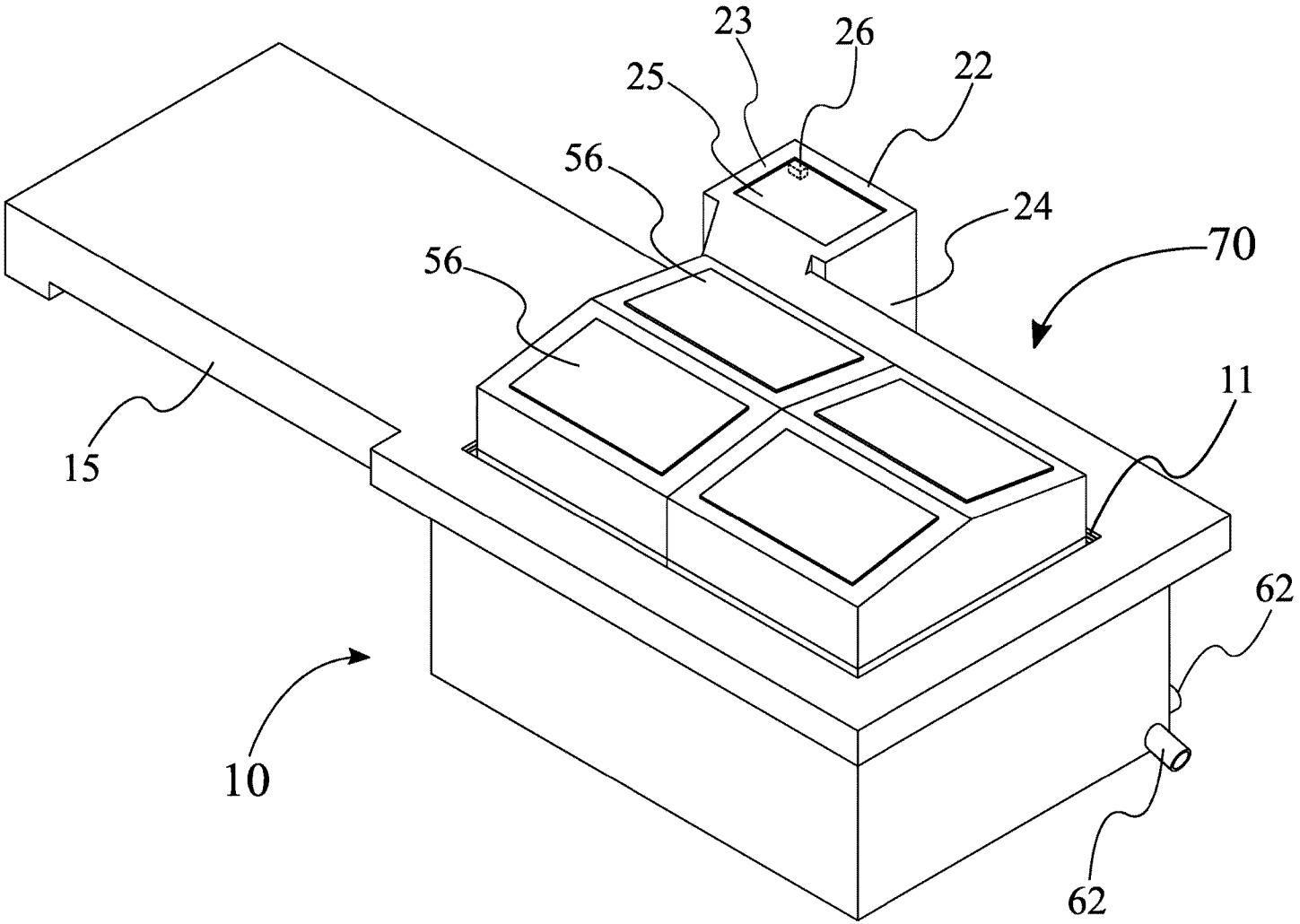
FIG. 14 is a perspective view of an alternative embodiment of the apparatus of the present invention with two plates installed in the cover assembly.
Figure 15:
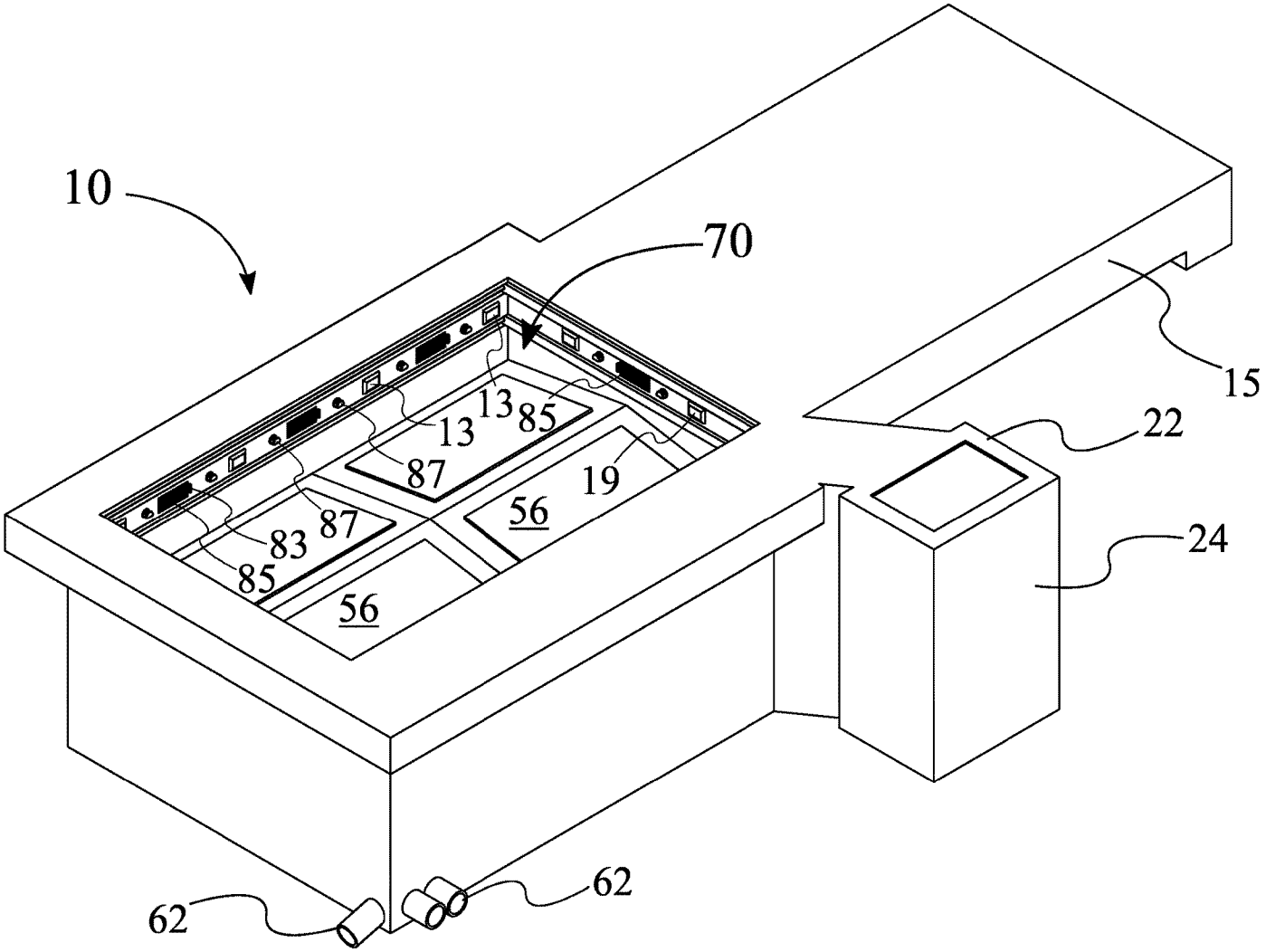
FIG. 15 is a perspective view of the alternative embodiment of the apparatus of the present invention, wherein at least one domicile (or the plurality thereof) is retracted into the foundation cavity where support actuators are retracted into the walls of the foundation, and wherein at least one temperature sensor, a plurality of air vents, and a plurality of sprinklers are mounted to the interior of the foundation cavity adjacent to the cover plate.

As can be seen in FIG. 4 to FIG. 6, the lift assembly 30 comprises a first platform 33, a second platform 34, and at least one lift 31. The at least one lift 31 further comprises a lift actuator 35, and a plurality of accordion struts 32. The first platform 33 is attached to the top of the at least one lift 31 and is terminally mounted to the bottom of the at least one domicile 70. The second platform 34 is attached to the bottom of the at least one lift 31 and is interiorly mounted to the bottom of the foundation cavity 12 of the foundation 10. The lift actuator 35 is attached to the at least one lift 31. In an alternative embodiment of the present invention, the at least one lift 31 can be a scissor lift, wherein the at least one lift 31 comprises a plurality of accordion struts 32, as can be seen FIG. 4 to FIG. 6.

Housed within the foundation cavity 12 and supporting the at least one domicile 70 is the lift assembly 30. The lift assembly 30 actuates the at least one domicile 70 to retract and deploy through the foundation aperture 11. The lift assembly 30 is further in connection to the supply system 50, accepting power and commands from the processor 51. Located beneath a respective domicile 70 is the at least one lift 31. The at least one lift 31 (or the plurality thereof) comprises a count equivalent to the at least one domicile 70 (or the plurality thereof). The at least one lift 31 further preferably comprises a single lift actuator 35 and utilizes the plurality of accordion struts 32 that actuates from the single linear lift actuator 35. The at least one lift 31 further utilize the first platform 33 that mounts to the underside of the respective domicile 70, and the second platform 34 that mounts to the bottom of the foundation cavity 12. The at least one lift 31 may deploy and collapse to deploy and retract the respective domicile 70 through the foundation aperture 12, respectively. Further, the first platform 33 of the at least one lift 31 may rest atop the plurality of support actuators 14 deployed from the plurality of support apertures 13 for added stability and reducing the sustained strain on the lift actuator 35.

Actuating the at least one lift 31 is the lift actuator 35. Preferably the lift actuator 35 comprises a single linear actuator that is in connection to the processor 51 and operated primarily thereby. The lift actuator 35 is further preferably hydraulically driven and supplied power by at least two batteries. A gearbox, gear assembly, pulley, or belt system may translate the manual mechanical input of the user into vertical translation of the at least one lift 31.

As can be seen in FIG. 1 to FIG. 13, the supply system 50 of the present invention comprises a processor 51, at least one input 52, a beacon 53, a relay 54, a plurality of batteries 55, a plurality of solar panels 56, at least one container 58, a plurality of pipes 62, at least one thermal unit 64, and a personal computing (PC) device 80. Specifically, the supply system 50 is mounted on the foundation 10. The processor 51 is electrically connected to the plurality of batteries 55. Both the beacon 53 and the relay 54 are electrically connected to the processor 51 and the plurality of batteries 55. Additionally, the processor 51 is electrically connected to the plurality of support actuators 14 of the foundation 10 through the relay 54 and the at least one cover actuator 19 of the cover assembly 15 of the foundation 10 through the relay 54. Further, the processor 51 is electrically connected to the satellite cover actuator 26 of the satellite structure 22 of the foundation 10 through the relay 54 and the lift actuator 35 of the lift assembly 30 through the relay 54.

As can be seen in FIG. 1 to FIG. 7, the plurality of solar panels 56 of the supply system 50 is exteriorly mounted on the at least one domicile 70 opposite the first platform 33 of the lift assembly 30 across the at least one domicile 70. The processor 51 is electrically connected to the plurality of solar panels 56 through the relay 54, wherein the processor 51 controls the plurality of solar panels 56 and the plurality of batteries 55 for electrical power generation and storage. The at least one container 58 is interiorly mounted within the foundation cavity 12 of the foundation 10 and the plurality of pipes 62 are connected with the at least one container 58. Additionally, the plurality of pipes 62 are connected with the at least one domicile 70, and the foundation 10. The processor 51 through the relay 54, wherein the processor 51 controls the water and/or liquid flows among the at least one container 58, the at least one domicile 70, and the exterior of the foundation 10. In one embodiment of the present invention, the at least one thermal unit 64 is interiorly mounted within the foundation cavity 12 of the foundation 10 and is connected to the at least one domicile 70 through the plurality of pipes 62. The at least one thermal unit 64 is also electrically connected to processor 51 through the relay 54, wherein the processor 51 controls the flows of heated and cooled air in/out of the at least one domicile 70. The PC device 80 is connected to the processor 51 through a wireless communication network and may include, but is not limited to smart mobile phone, laptop computer, desktop computer, tablet, cloud computing device, server computer, etc. Further, the at least one input 52 is electrically connected to the processor 51 through the beacon 53.

Located in the foundation 10 and facilitating resources to the lift assembly 30 and the at least one domicile 70 is the supply system 50. The supply system 50 is centralized about the processor 51 that administrates the distribution of water and electricity throughout the apparatus. Located arbitrarily within the foundation 10 and in connection to the at least one input 52, the beacon 53, the relay 54, the plurality of batteries 55, the plurality of solar panels 56, the at least one container 58, the lift assembly 30, the plurality of support actuators 14, the at least one cover actuator 19, the satellite cover actuator 26, and a at least one actuated closure 71 of the respective domicile 70 is the processor 51. The processor 51 articulates the system depending upon the conditions intercepted by the relay 54. The processor 10 may engage the plurality of support actuators 14 to retract into the walls of the foundation aperture 11, and thereafter engaging lift assembly 30 to lower the at least one domicile 70 into the foundation cavity 12. Afterwards, the processor 51 may engage the at least one cover plate actuator 19 to occlude the foundation aperture 11. Simultaneously the processor 51 may engage the satellite foundation 24 and satellite cover actuator 26 thereof similarly. Proceeding an all clear or override by the user, the processor 51 engages the at least one cover plate actuator 26 to once more open the foundation aperture 11. Then the processor 51 engages the lift assembly 30 to raise the at least one lift 31 and the at least one domicile 70 thereon through the foundation aperture 11. Thereafter, the processor 51 may engage with the plurality of support actuators 14 to protrude beneath the first platform 33 of the at least one lift 31, stabilizing the assembly and respective domicile 70. The processor 51 further may operate as a regulator for the harvesting of solar power conferred by the plurality of solar panels 56 and the administration of electricity throughout the present invention. The processor 51 may include, but is not limited to, a display, manual control buttons/switches, alert/warning lights, etc. The display can include, but is not limited to, a LED (Light Emitting Diode), touch-screen display, television (TV) set screen, etc. The manual control buttons/switches and alert/warning lights are used for the interactions between the user and the processor 51 for various controls and signals of the present invention. The processor 51 can process and display real-time information including, but not limited to, weather information, upcoming emergency warning such as tornado, hurricane, etc., electrical power generation, electrical usage, water usage, indoor conditions such as temperature, humidity, barometric pressure, etc., status of the at least one domicile 70, that cover plate 18 of the cover assembly 15, the lift assembly 30, etc. The information processed and displayed by the processor 51 includes, but is not limited to, data, historical and ongoing graphs, etc.

Preferably at least one input 52 is in connection to the processor 51 about the foundation 10. The user may engage therewith to raise and lower the at least one lift 31 that the at least one input 52 is correspondent to. The at least one input 52 may be disposed within the satellite foundation 24 and satellite cavity 27 thereof and may further be housed in the at least one domicile 70.

Arbitrarily located but in connection to the processor 51 is the beacon 53. The beacon 53 may transmit a signal external to the apparatus, facilitating transmission from the user concerning aid or location and/or the status of the system. Further arbitrarily located about the foundation 10 but in connection to the processor 51 is the relay 54. The relay 54 may permit inbound transmissions to the processor 51. Additionally, the relay 54 may confer commands to the processor 51 such as those imparted by the extraneous PC device 80 or similar.

In connection to the processor 51 and housing the energy for the system therein is the plurality of batteries 55. The plurality of batteries 55 preferably comprises a count of two for each individual lift of the at least one lift 31, wherein there persists a primary battery to facilitate regular operations of the apparatus, alongside a secondary backup battery in the event of the first battery failing or depleting.

Located on the roof of the individual domicile 70 is the plurality of solar panels 55, wherein the plurality of solar panels 55 may supply energy to a regulator and/or the processor 51 to be stored in the plurality of batteries 55.

Disposed within the foundation cavity 12 and in connection to the plurality of pipes 62, and the processor 51 is the at least one container 58. The at least one container 58 houses water and other fluids therein that may be employed by the hydraulics systems or actuators throughout the apparatus.

In connection to the at least one container 58 and integrated with the plumbing system is the plurality of pipes 62 that pass through the foundation 12. At least one of the plurality of pipes 62 facilitates the introduction of water to the at least one container 58. Further a second pipe of the plurality of pipes 62 preferably facilitates the outflow or wastewater of the apparatus to a location at a distance from the apparatus to mitigate flooding of the foundation cavity 12, the at least one domicile 70, or backup in the plumbing system.

Disposed arbitrarily throughout the apparatus is the at least one thermal unit 64, wherein the at least one thermal unit 64 may be connected to the at least one domicile 70 through the plurality of pipes 62 to transport cooled or heated air therethrough. Further, preferably, at least one thermal unit 64 is preferably located and operational within the foundation cavity 12 and the satellite foundation 24 and/or the satellite cavity 27 thereof. Preferably the at least one thermal unit 64 is in connection to the processor 51 and operated thereby either by the remote extraneous PC device 80 or the at least one input 52.

As can be seen in FIG. 4 to FIG. 6, the at least one domicile further comprises the at least one actuated closure 71. Mounted atop the lift assembly 30 is the at least one domicile 70, where preferably the count of the at least one domicile 70 is equivalent to the count of the at least one lift 30. The at least one domicile 70 further connects to the plurality of batteries 55 to utilize electricity therefrom. The at least one domicile 70 further is connected to the at least one container 58 and the plurality of pipes 62 to facilitate fluid transfer into and out of the at least one domicile 70. The at least one domicile 70 further supports the plurality of solar panels 56 on the roof of the at least one domicile 70. The at least one domicile 70 may be embodied by a shed, garage or similar upon the satellite foundation 24 of the satellite structure 22.

Located on the lateral wall of a first domicile of the at least one domicile 70 adjacent with a flush second domicile is the at least one actuated closure 71. Preferably a complementing actuated closure is located on the second domicile that mirrors the first. The at least one actuated closure 71 may automatically close if any additional domiciles do not retract either due to damage suffered or environmental volatility. Otherwise, the at least one actuated closure 71 (or the pair thereof) may be open to permit the passage of occupants between adjacent domicile units.

As can be seen in FIG. 14 to FIG. 20, the cover assembly 15 of the foundation 10 comprises a second plate 81, which is movably positioned within the cover cavity 16 in the same way as the cover plate 18. Additionally, the second plate 81 is positioned parallel to and beneath the cover plate 18. The second plate 81 is translationally adapted to pen and close the foundation cavity 12 to conceal the at least one domicile 70 in any emergency situation. The second plate 81 is actuated when the cover plate 18 is actuated and the temperature of the air in the space between the cover plate 18 and the at least one domicile 70 reaches a predetermined maximum value, including, but not limited to, 1,300° F. to 1,400° F., etc. Any other situation, including, but not limited to, smoke, fire, wild fire, burning and/or melting of the cover plate 18, or any part of the present invention, may activate the second plate 81 to close. Thus, the second plate 81 offers a second level protection to the at least one domicile 70, especially in case the cover plate 18 may be subject to severe calamity and failing.

As can be seen in FIG. 13, FIG. 15 to FIG. 16, and FIG. 18 to FIG. 19, the at least one cover actuator 19 of the cover assembly 15 comprises a second plate actuator 82, which is interiorly mounted to at least one distal end of the foundation 10 adjacent the cover plate 18. Additionally, the second plate actuator 82 of the at least one cover actuator 19 is adapted to translate the second plate 81 to open and close the foundation cavity 12 when desired.

As can be seen in FIG. 15 to FIG. 20, the foundation 10 comprises at least one temperature sensor 83 and a heating, ventilation, and air conditioning (HVAC) system 84. Specifically, the at least one temperature sensor 83 is mounted to at least one distal end of the foundation 10 adjacent the cover plate 18 and the HVAC system 84 is positioned within the satellite cavity 27 of the satellite structure 22. Additionally, the HVAC system 84 comprises a plurality of air vents 85. The plurality of air vents 85 is interiorly mounted to one distal end of the foundation 10 adjacent the at least one temperature sensor 83.

Figure 16:
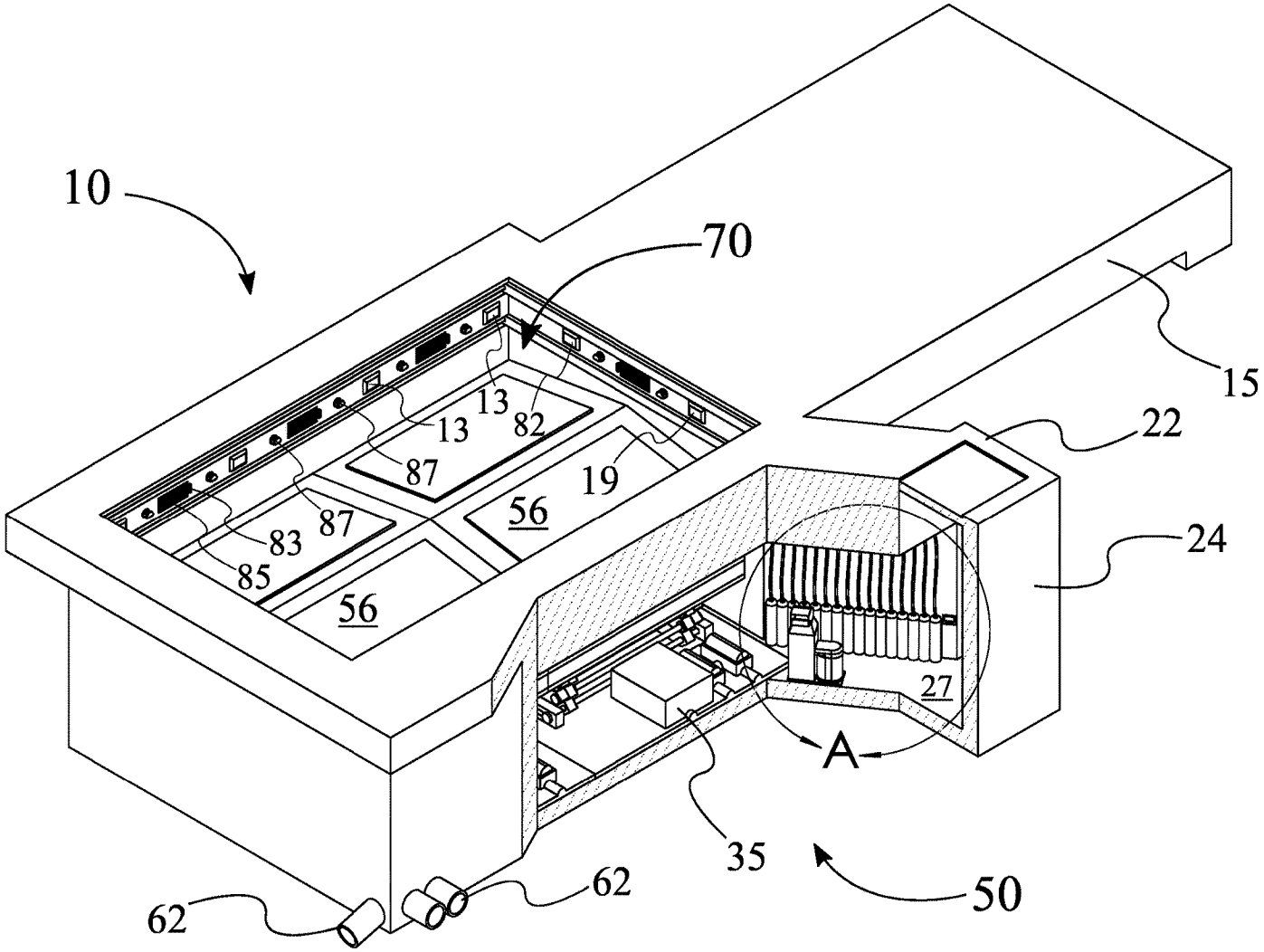
FIG. 16 is a perspective view of the alternative embodiment of the apparatus of the present invention, wherein the air-conditioning system and the fire sprinkler tanks are positioned in the satellite cavity, and wherein a view of detail A is indicated.
Figure 17:
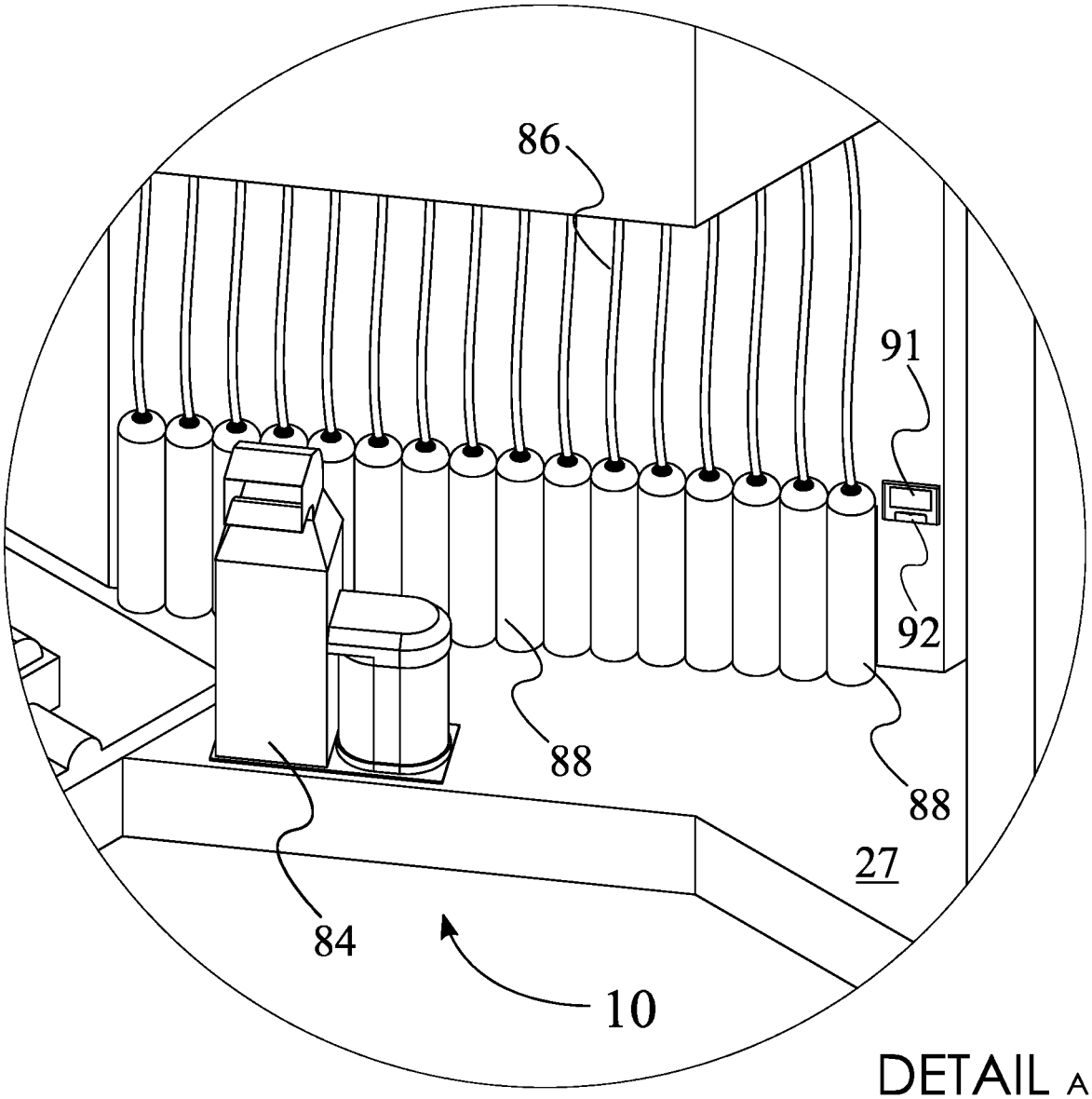
FIG. 17 is a perspective view of the alternative embodiment of the apparatus of the present invention, wherein the view of detail A is illustrated.
Figure 18:
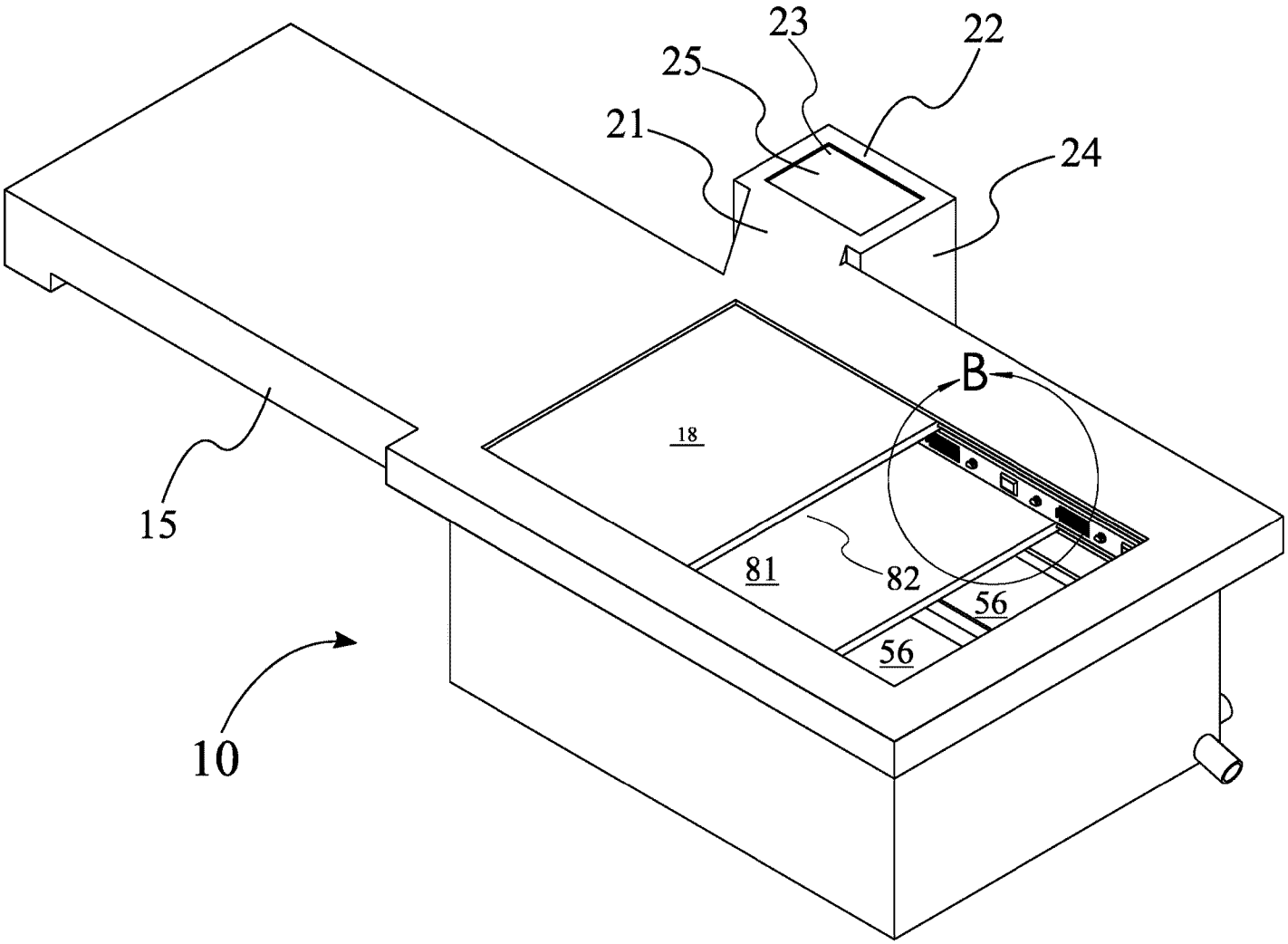
FIG. 18 is a perspective view of the alternative embodiment of the apparatus of the present invention, wherein both the cover plate and a second plate are being deployed to occlude the foundation cavity, and wherein a view of detail B is indicated.
Figure 19:
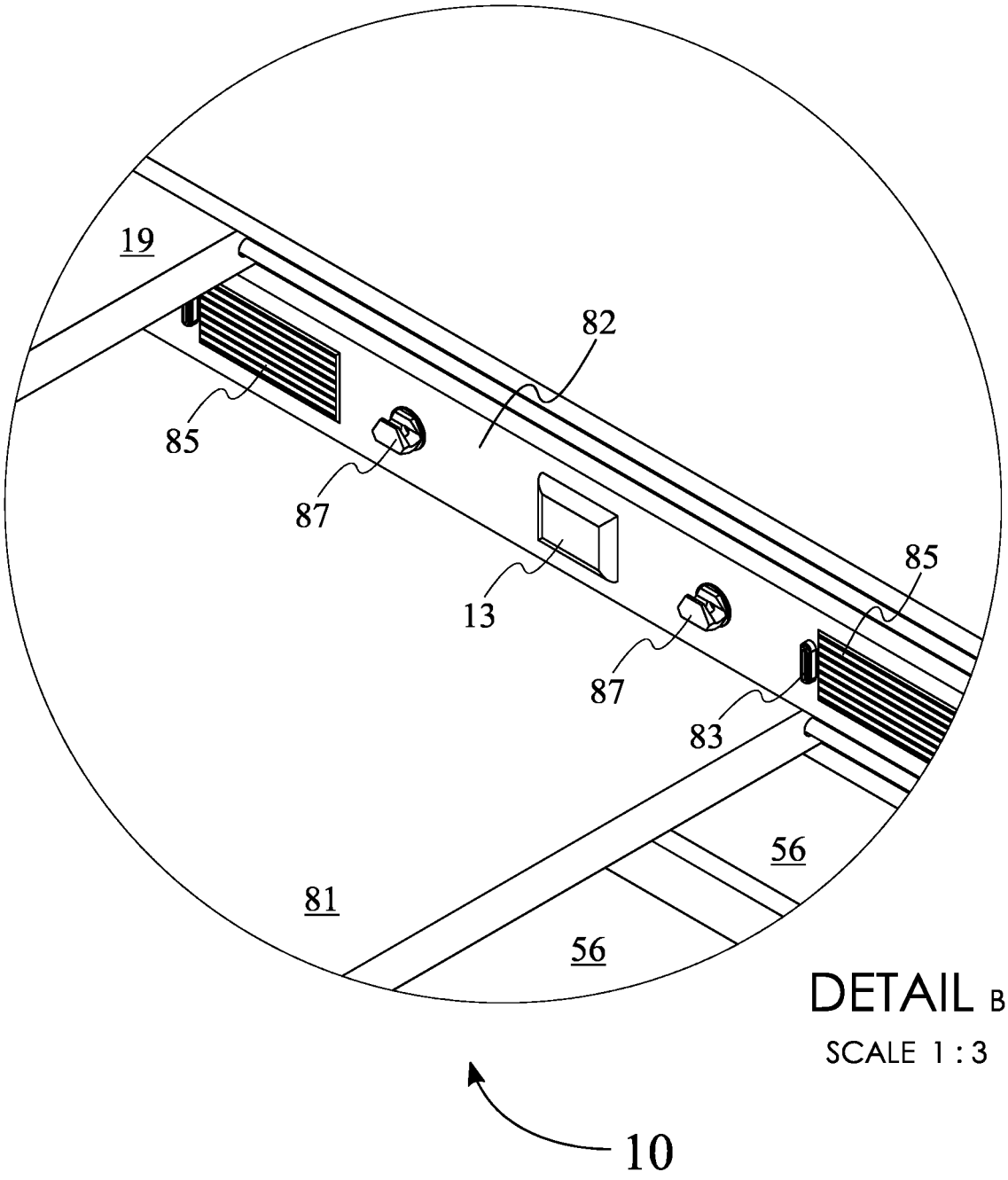
FIG. 19 is a perspective view of the alternative embodiment of the apparatus of the present invention, wherein the view of detail B is illustrated.
Figure 20:
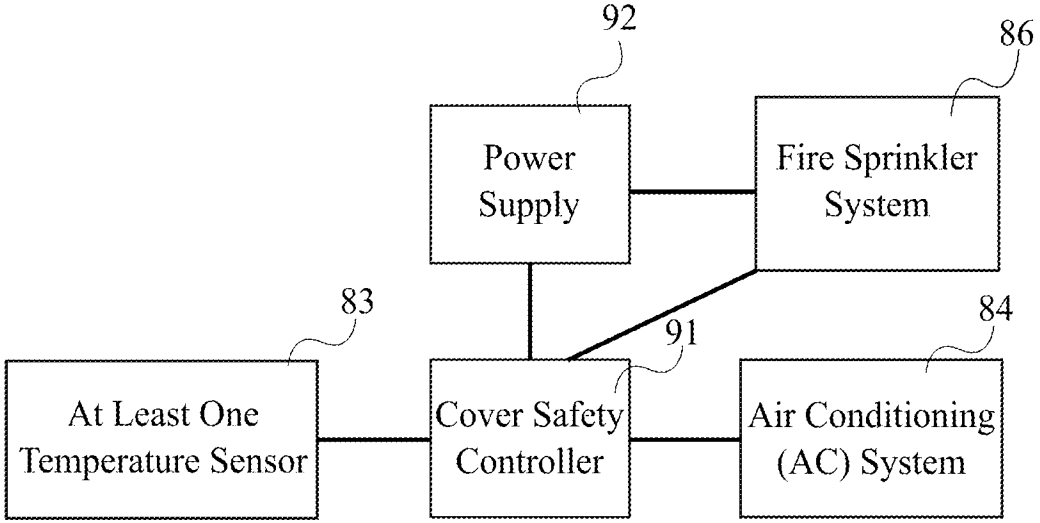
FIG. 20 is an electrical diagram of the alternative embodiment of the apparatus of the present invention.

As can be seen in FIG. 16 to FIG. 17, the foundation 10 comprises a cover safety controller 91 and a power supply 92. Both the cover safety controller 91 and the power supply 92 are positioned in the satellite cavity 27 of the satellite structure 22. The cover safety controller 91 is electrically connected to the power supply 92, which provides electricity to the cover safety controller 91. Additionally, the cover safety controller 91 is electrically connected to the at least one temperature sensor 83 and the HVAC system 84. Further, the cover safety controller 91 is adapted to control the temperature of the air in the foundation cavity through the HVAC system 84 with the input from the at least one temperature sensor 83, wherein the cover plate 18 is actuated to close the foundation aperture 11. In one embodiment of the present invention, when the cover plate 18 is actuated and closed, the cover safety controller 91 is adapted to control the air in the foundation cavity 27 through the HVAC system 84 above a predetermined lower limit temperature, including, but not limited to, a temperature in the range of 0 to 40° F., or any suitable value when the cover plate 18 is exposed to cold weather, and/or accumulated snow/ice, etc. In an alternative embodiment of the present invention, the cover safety controller 91 is adapted to control the temperature of the air in the closed space between the cover plate 18 and the second plate 81 through the HVAC system 84 below a predetermined maximum temperature, including, but not limited to, 200° F. to 500° F. with the input from the at least one temperature sensor 83 in certain emergency situations, including, but not limited to, smoke, fire, wild fire, extreme high temperature of the cover plate, explosion on and/or of the cover plate, burning and/or melting of the cover plate 18, or any part of the present invention, etc. During any of these situations, the cover plate 18 is actuated to close the foundation aperture 11, and the second plate 81 is actuated to close the foundation cavity 12 when the air below the cover plate 18 reaches a predetermined upper limit temperature, including, but not limited to, a temperature in the range of 200° F. to 500° F., thus effectively protecting the second plate 81 and the at least one domicile 70 thereunder.

As can be seen in FIG. 15 to FIG. 19, the foundation 10 comprises a fire sprinkler system 86. The fire sprinkler system 86 comprises a plurality of sprinkler heads 87 and a plurality of fire-retardant tanks 88. Additionally, the plurality of fire-retardant tanks 88 is positioned in the satellite cavity 12 of the satellite structure 22, and the plurality of sprinkler heads 87 is mounted to at least one distal end of the foundation 10 adjacent the cover plate 18. Further, the fire sprinkler system 86 is adapted to extinguish smoke/fire inside the foundation 10 beneath the cove plate 18 through the plurality of sprinkler heads 87 of the fire sprinkler system 86. Each of the plurality of fire-retardant tanks 88 may be replaced and/or refilled once exhausted.

Although the invention has been explained in relation to its preferred embodiment, it is to be understood that many other possible modifications and variations can be made without departing from the spirit and scope of the invention as hereinafter claimed.

What is claimed is:

1. A building sheltering structure comprising:

a foundation;

a lift assembly;

at least one domicile;

the foundation comprising a foundation aperture, a foundation cavity, and a cover assembly;

the cover assembly being exteriorly attached to the foundation adjacent the foundation aperture;

the cover assembly comprising a cover plate and a cover cavity;

the cover plate being movably positioned within the cover cavity;

the cover plate being translationally adapted to open and close the foundation aperture;

the lift assembly being positioned within the foundation cavity opposite the foundation aperture;

the lift assembly being mounted to the at least one domicile;

the lift assembly being configured to selectively elevate and retract the at least one domicile through the foundation aperture;

the foundation comprising a satellite structure and satellite tunnel;

the satellite structure being positioned adjacent the foundation;

the satellite structure being connected to the foundation through the satellite tunnel;

the satellite structure comprising a satellite aperture, a satellite foundation, and a satellite cavity;

the satellite cavity being positioned within the satellite structure;

the satellite aperture being positioned on the satellite structure adjacent the foundation aperture of the foundation;

the satellite cavity being connected with the foundation cavity of the foundation through the satellite tunnel;

the cover assembly comprising a second plate;

the second plate being movably positioned within the cover cavity;

the second plate being positioned parallel to and beneath the cover plate; and the second plate being translationally adapted to open and close the foundation cavity.

2. The building sheltering structure as claimed in claim 1 comprising:

the at least one cover actuator comprising a second plate actuator;

the second plate actuator being interiorly mounted to at least one distal end of the foundation adjacent the cover plate; and the second plate actuator being adapted to translate the second plate to open and close the foundation cavity.

3. The building sheltering structure as claimed in claim 1 comprising:

the foundation comprising at least one temperature sensor and a heating, ventilation, and air conditioning (HVAC) system;

the at least one temperature sensor being mounted to at least one distal end of the foundation adjacent the cover plate;

the HVAC system being positioned within the satellite cavity;

the HVAC system comprising a plurality of air vents; and the plurality of air vents being interiorly mounted to one distal end of the foundation adjacent the at least one temperature sensor.

4. The building sheltering structure as claimed in claim 3 comprising:

the foundation comprising a cover safety controller and a power supply;

both the cover safety controller and the power supply being positioned in the satellite cavity;

the cover safety controller being electrically connected to the power supply;

the cover safety controller being electrically connected to the at least one temperature sensor and the HVAC system; and the cover safety controller being adapted to control the temperature of the air in the foundation cavity through the HVAC system with the input from the at least one temperature sensor; and wherein the cover plate is actuated to close the foundation aperture.

5. The building sheltering structure as claimed in claim 4 comprising:

the cover safety controller being adapted to control the air in the foundation cavity through the HVAC system above a predetermined lower limit temperature.

6. The building sheltering structure as claimed in claim 4 comprising:

the cover safety controller being adapted to control the air in the foundation cavity through the HVAC system below a predetermined maximum temperature;

wherein the second plate is actuated to close the foundation cavity; and wherein the air below the cover plate reaches a predetermined upper limit temperature.

7. The building sheltering structure as claimed in claim 1 comprising:

the foundation comprising a fire sprinkler system;

the fire sprinkler system comprising a plurality of sprinkler heads and a plurality of fire-retardant tanks;

the plurality of fire-retardant tanks being positioned in the satellite cavity;

the plurality of sprinkler heads being mounted to at least one distal end of the foundation adjacent the cover plate; and the fire sprinkler system being adapted to extinguish smoke/fire inside the foundation beneath the cove plate through the plurality of sprinkler heads.

8. A building sheltering structure comprising:

a foundation;

a lift assembly;

at least one domicile;

the foundation comprising a foundation aperture, a foundation cavity, and a cover assembly;

the cover assembly being exteriorly attached to the foundation adjacent the foundation aperture;

the cover assembly comprising a cover plate, a second plate, and a cover cavity;

the cover plate being movably positioned within the cover cavity;

the cover plate being translationally adapted to open and close the foundation aperture;

the second plate being movably positioned within the cover cavity;

the second plate being positioned parallel with and beneath the cover plate;

the second plate being translationally adapted to open and close the foundation cavity;

the lift assembly being positioned within the foundation cavity opposite the foundation aperture;

the lift assembly being mounted to the at least one domicile; and the lift assembly being configured to selectively elevate and retract the at least one domicile through the foundation aperture.

9. The building sheltering structure as claimed in claim 8 comprising:

the foundation comprising at least one temperature sensor and a heating, ventilation, and air conditioning (HVAC) system;

the at least one temperature sensor being mounted to at least one distal end of the foundation adjacent the cover plate;

the HVAC system being positioned within the satellite cavity;

the HVAC system comprising a plurality of air vents; and the plurality of air vents being interiorly mounted to one distal end of the foundation adjacent the at least one temperature sensor.

10. The building sheltering structure as claimed in claim 9 comprising:

the foundation comprising a cover safety controller and a power supply;

both the cover safety controller and the power supply being positioned in the satellite cavity;

the cover safety controller being electrically connected to the power supply;

the cover safety controller being electrically connected to the at least one temperature sensor and the HVAC system; and the cover safety controller being adapted to control the temperature of the air in the foundation cavity through the HVAC system with the input from the at least one temperature sensor; and wherein the cover plate is actuated to close the foundation aperture.

11. The building sheltering structure as claimed in claim 10 comprising:

the cover safety controller being adapted to control the air in the foundation cavity through the HVAC system above a predetermined lower limit temperature.

12. The building sheltering structure as claimed in claim 10 comprising:

the cover safety controller being adapted to control the air in the foundation cavity through the HVAC system below a predetermined maximum temperature;

wherein the second plate is actuated to close the foundation cavity; and wherein the air below the cover plate reaches a predetermined upper limit temperature.

13. The building sheltering structure as claimed in claim 8 comprising:

the foundation comprising a fire sprinkler system;

the fire sprinkler system comprising a plurality of sprinkler heads and a plurality of fire-retardant tanks;

the plurality of fire-retardant tanks being positioned in the satellite cavity;

the plurality of sprinkler heads being mounted to at least one distal end of the foundation adjacent the cover plate; and the fire sprinkler system being adapted to extinguish smoke/fire inside the foundation beneath the cove plate through the plurality of sprinkler heads.

14. The building sheltering structure as claimed in claim 8 comprising:

the foundation comprising a satellite structure and satellite tunnel;

the satellite structure being positioned adjacent the foundation;

the satellite structure being connected to the foundation through the satellite tunnel;

the satellite structure comprising a satellite aperture, a satellite foundation, and a satellite cavity;

the satellite cavity being positioned within the satellite structure;

the satellite aperture being positioned on the satellite structure adjacent the foundation aperture of the foundation; and the satellite cavity being connected with the foundation cavity of the foundation through the satellite tunnel.

15. The building sheltering structure as claimed in claim 14 comprising:

the satellite structure comprising a satellite cover plate and a satellite cover actuator;

the satellite cover actuator being mounted to the satellite foundation;

the satellite cover actuator being positioned within the satellite cavity adjacent the satellite aperture;

the satellite cover plate being mounted to the satellite foundation adjacent the satellite aperture;

the satellite cover plate being connected with the satellite cover actuator; and the satellite actuator being configured to selectively open and close the satellite cavity through translating the satellite cover plate over the satellite aperture.

16. The building sheltering structure as claimed in claim 8 comprising:

the cover assembly comprising a cover aperture and at least one cover actuator;

the cover aperture being terminally positioned on the cover cavity;

the cover cavity being interiorly positioned on the foundation;

the at least one cover actuator being interiorly mounted to at least one distal end of the foundation;

the at least one cover actuator being mounted to the cover plate adjacent the cover aperture;

the at least one cover actuator being adapted to translate the cover plate to open and close the foundation cavity through the foundation aperture of the foundation;

the cover assembly actuator comprising a second plate actuator;

the second plate actuator being interiorly mounted to at least one distal end of the foundation adjacent the cover plate; and the second plate actuator being adapted to translate the second plate to open and close the foundation cavity.

17. The building sheltering structure as claimed in claim 8 comprising:

the lift assembly comprising a first platform, a second platform, and at least one lift;

the first platform being attached to the top of the at least one lift;

the first platform being terminally mounted to the bottom of the at least one domicile;

the second platform being attached to the bottom of the at least one lift; and the second platform being interiorly mounted to the bottom of the foundation cavity of the foundation.

18. The building sheltering structure as claimed in claim 8 comprising:

the foundation comprising a plurality of support apertures;

the plurality of support apertures being distributed interiorly on the foundation adjacent the foundation aperture;

each of the plurality of support apertures comprising a support actuator;

the support actuator being movably mounted within each of the plurality of support apertures; and wherein the support actuator is adapted to slide in and out of each of the plurality of support apertures to support the cover plate of the foundation or the at least one domicile.

19. The building sheltering structure as claimed in claim 8 comprising:

the satellite structure comprising a satellite cover plate and a satellite cover actuator;

the satellite cover actuator being mounted to the satellite foundation;

the satellite cover actuator being positioned within the satellite cavity adjacent the satellite aperture;

the satellite cover plate being mounted to the satellite foundation adjacent the satellite aperture;

the satellite cover plate being connected with the satellite cover actuator; and the satellite cover actuator being configured to selectively open and close the satellite cavity through translating the satellite cover plate over the satellite aperture.

20. The building sheltering structure as claimed in claim 8 comprising:

a supply system;

the supply system comprising a processor, a beacon, a relay, and a plurality of batteries;

the processor being electrically connected to the plurality of batteries;

both the beacon and the relay being electrically connected to the processor; and both the beacon and the relay being electrically connected to the plurality of batteries.

* * * * *